US008026032B2

(12) United States Patent
Iwatsuki et al.

(10) Patent No.: US 8,026,032 B2
(45) Date of Patent: Sep. 27, 2011

(54) CARRIER, SUPPLEMENTAL DEVELOPER, DEVELOPER IN IMAGE DEVELOPER, DEVELOPER FEEDING APPARATUS, IMAGE FORMING APPARATUS AND PROCESS CARTRIDGE

(75) Inventors: Hitoshi Iwatsuki, Numazu (JP); Tomio Kondou, Numazu (JP); Shinichiro Yagi, Numazu (JP); Masashi Nagayama, Mishima (JP)

(73) Assignee: Ricoh Company, Ltd., Tokyo (JP)

( * ) Notice: Subject to any disclaimer, the term of this patent is extended or adjusted under 35 U.S.C. 154(b) by 783 days.

(21) Appl. No.: 11/870,613

(22) Filed: Oct. 11, 2007

(65) Prior Publication Data

US 2008/0096121 A1 Apr. 24, 2008

(30) Foreign Application Priority Data

Oct. 20, 2006 (JP) ..... 2006-285957

(51) Int. Cl.
*G03G 9/10* (2006.01)

(52) U.S. Cl. ..... 430/111.1; 430/111.3; 430/111.32; 430/111.35

(58) Field of Classification Search ..... 43/111.1, 43/111.3, 111.32, 111.35
See application file for complete search history.

(56) References Cited

U.S. PATENT DOCUMENTS 5,380,616 A 1/1995 Aoki et al.
5,519,316 A 5/1996 Hagiwara et al.
6,096,466 A 8/2000 Imai et al.
6,183,926 B1 2/2001 Kuroda et al.
6,258,502 B1 7/2001 Nakamura et al.
6,403,275 B1 6/2002 Kuramoto et al.
6,479,204 B1 11/2002 Uchinokura et al.
6,503,676 B2 1/2003 Yamashita et al.
6,630,276 B2 10/2003 Sugiura et al.
6,641,969 B2 11/2003 Uchinokura et al.
6,780,556 B2 8/2004 Sugiura et al.
6,821,699 B2 11/2004 Kondou et al.
6,828,075 B2 * 12/2004 Suzuki et al. ..... 430/111.1
6,939,653 B2 9/2005 Suzuki et al.
7,052,815 B2 5/2006 Sawada et al.
7,060,407 B2 6/2006 Nagayama et al.

(Continued)

FOREIGN PATENT DOCUMENTS

EP 1 477 863 A2 11/2004

(Continued)

OTHER PUBLICATIONS

U.S. Appl. No. 12/189,384, filed Aug. 11, 2008, Imahashi et al.

(Continued)

*Primary Examiner* — Hoa Le
(74) *Attorney, Agent, or Firm* — Oblon, Spivak, McClelland, Maier & Neustadt, L.L.P.

(57) ABSTRACT

A carrier for use in an image forming apparatus in which a toner and a carrier are fed to an image developer thereof and an extra developer including the toner and the carrier in the image developer is discharged therefrom, wherein at least one of the carrier fed to the image developer and a carrier readily contained therein includes a core material; and a coated film coating the core material, and wherein the coated film includes a binder resin and a particulate material having a ratio of an average particle diameter thereof to an average thickness of the coated film of from 0.01 to 1, and includes concavities and convexities having an average difference of elevation of from 0.02 to 3.0 μm.

24 Claims, 7 Drawing Sheets

U.S. PATENT DOCUMENTS

| | | | | |
|---|---|---|---|---|
| 7,132,210 | B2 | 11/2006 | Suzuki et al. | |
| 7,144,669 | B2 | 12/2006 | Suzuki et al. | |
| 7,163,774 | B2 | 1/2007 | Shiraishi et al. | |
| 7,166,404 | B2 * | 1/2007 | Matsuda et al. | 430/111.35 |
| 7,172,846 | B2 | 2/2007 | Yamashita et al. | |
| 7,217,485 | B2 | 5/2007 | Hasegawa et al. | |
| 7,226,713 | B2 | 6/2007 | Yamashita et al. | |
| 7,232,632 | B2 | 6/2007 | Kondou et al. | |
| 7,235,338 | B2 | 6/2007 | Takada et al. | |
| 7,252,919 | B2 | 8/2007 | Suzuki et al. | |
| 7,272,347 | B2 | 9/2007 | Yamashita et al. | |
| 7,344,812 | B2 * | 3/2008 | Suzuki et al. | 430/108.1 |
| 7,527,908 | B2 * | 5/2009 | Iwatsuki et al. | 430/111.1 |
| 7,553,598 | B2 * | 6/2009 | Suzuki et al. | 430/111.35 |
| 7,592,116 | B2 * | 9/2009 | Suzuki et al. | 430/111.35 |
| 2003/0161645 | A1 * | 8/2003 | Azami et al. | 399/30 |
| 2003/0180643 | A1 | 9/2003 | Suzuki et al. | |
| 2003/0186154 | A1 * | 10/2003 | Suzuki et al. | 430/111.1 |
| 2004/0253528 | A1 | 12/2004 | Yamashita et al. | |
| 2005/0079434 | A1 | 4/2005 | Suzuki et al. | |
| 2005/0089786 | A1 | 4/2005 | Sugiura et al. | |
| 2005/0158643 | A1 | 7/2005 | Yamaguchi et al. | |
| 2005/0163537 | A1 | 7/2005 | Muramatsu et al. | |
| 2005/0238391 | A1 | 10/2005 | Hibino | |
| 2005/0238980 | A1 | 10/2005 | Yamashita et al. | |
| 2005/0260516 | A1 | 11/2005 | Tomita et al. | |
| 2006/0024604 | A1 | 2/2006 | Sugiura et al. | |
| 2006/0024606 | A1 | 2/2006 | Suzuki et al. | |
| 2006/0056863 | A1 | 3/2006 | Murata | |
| 2006/0057487 | A1 | 3/2006 | Nagayama et al. | |
| 2006/0073405 | A1 * | 4/2006 | Matsuda et al. | 430/111.1 |
| 2006/0127152 | A1 | 6/2006 | Nagayama et al. | |
| 2006/0210905 | A1 | 9/2006 | Imahashi et al. | |
| 2006/0210906 | A1 * | 9/2006 | Suzuki et al. | 430/111.35 |
| 2006/0222987 | A1 | 10/2006 | Suzuki et al. | |
| 2006/0251982 | A1 * | 11/2006 | Iwatsuki et al. | 430/111.1 |
| 2006/0291911 | A1 | 12/2006 | Yamashita et al. | |
| 2007/0015078 | A1 | 1/2007 | Suzuki et al. | |
| 2007/0031748 | A1 | 2/2007 | Kotsugai et al. | |
| 2007/0048652 | A1 | 3/2007 | Imahashi et al. | |

FOREIGN PATENT DOCUMENTS

| | | |
|---|---|---|
| JP | 58-108548 | 6/1983 |
| JP | 1-19584 | 4/1989 |
| JP | 2-21591 | 5/1990 |
| JP | 3-628 | 1/1991 |
| JP | 3-145678 | 6/1991 |
| JP | 5-273789 | 10/1993 |
| JP | 6-202381 | 7/1994 |
| JP | 7-140723 | 6/1995 |
| JP | 8-6307 | 1/1996 |
| JP | 8-179570 | 7/1996 |
| JP | 8-234550 | 9/1996 |
| JP | 8-286429 | 11/1996 |
| JP | 9-160304 | 6/1997 |
| JP | 2683624 | 8/1997 |
| JP | 11-223960 | 8/1999 |
| JP | 2001-188388 | 7/2001 |
| JP | 2007-286078 | 11/2007 |

OTHER PUBLICATIONS

U.S. Appl. No. 12/282,077, filed Sep. 8, 2008, Nagayama et al.

* cited by examiner

CARRIER, SUPPLEMENTAL DEVELOPER, DEVELOPER IN IMAGE DEVELOPER, DEVELOPER FEEDING APPARATUS, IMAGE FORMING APPARATUS AND PROCESS CARTRIDGE

BACKGROUND OF THE INVENTION

1. Field of the Invention

The present invention relates to a carrier for use in two-component developers used for electrophotography and electrostatic recording.

2. Discussion of the Background

In an electrophotographic image forming apparatus such as a copier or a printer, an image bearer uniformly charged is irradiated to form a latent image thereon; the latent image is developed with a toner to form a toner image; and the toner image is transferred onto a transfer material such as a recording paper.

The transfer material bearing the toner image passes through a fixer wherein the toner image is fixed thereon upon application of heat or pressure.

In the image forming apparatus, an image developer developing the latent image on the image bearer uses a one-component developing method using a toner including a magnetic material or a two-component developing method using a developer including a toner and a carrier.

The image developer using the two-component developing method has good developability and is used for most of the image forming apparatuses currently used. Particularly in recent years, many color-image forming apparatuses forming full-color or multi-color images are used, and demand for the image developer using the two-component developing method is further increasing.

The toner and carrier are stirred in the image developer using the two-component developing method, and the toner is frictionally-charged with the carrier and electrostatically attracted to the outer surface of the carrier. The carrier bearing the toner is transported to a developing area where the toner leaves from the carrier and electrostatically adheres to the latent image on the image bearer upon application of developing bias to form a toner image. Therefore, in the two-component developing method, it is essential that the carrier stably charges the toner when stirred before and after used for long periods to produce images satisfying high durability and stability.

In the typical image developer using a two-component developer, a toner is consumed and a carrier remains therein in the meantime while developing images. Therefore, the carrier being stirred with the toner deteriorates as it is more frequently stirred therewith because a resin coated on the carrier peels and the toner adheres thereto. Accordingly, the resistivity of the carrier and the chargeability of the developer gradually deteriorate, and the developability of the developer excessively increases. Resultantly, image density excessively increases and foggy images are produced.

In order to solve this problem, Japanese Published Examined Patent Application No. 2-21591 discloses a trickle image developer wherein a carrier is gradually replaced while a toner is consumed for developing images to prevent variation of the charge quantity of the developer for stabilizing the image density.

However, even in the image developer disclosed in Japanese Published Examined Patent Application No. 2-21591, deteriorated carrier gradually increases as the developer is used for a long time and it is difficult to prevent increase of the image density.

Japanese Published Unexamined Patent Application No. 3-14 5678 discloses a supplemental developer to be properly fed in the image developer, wherein a carrier has a higher resistivity than that of a carrier readily contained in the image developer to maintain the chargeability and prevent deterioration of image quality.

Further, Japanese Published Unexamined Patent Application No. 11-223960 discloses a supplemental developer including a carrier imparting higher charge quantity to a toner to maintain the chargeability and prevent deterioration of image quality.

However, the carrier quantity replaced in the image developer differs with the difference of the toner consumption, the resistivity or charge quantity of the developer disclosed in Japanese Published Unexamined Patent Applications Nos. 3-145678 and 11-223960 varies, resulting in variation of image density.

Japanese Published Unexamined Patent Application No. 8-234550 discloses a method of sequentially feeding plural developers including carriers having different properties from those of a carrier readily contained in an image developer.

However, practically, it is quite difficult to feed sequentially feeding the plural developers including carriers having different properties in the image developer so as not be mixed with each other because the specific gravities of a toner and a carrier are extremely different from each other. In addition, the carrier tends to deteriorate because the toner quantity is too large for the carrier in the developer, and which does not produce images having stable quality.

As disclosed in Japanese Published Unexamined Patent Application No. 8-234550, when silicone-coated layer coated on a core material of the carrier is simply increased to increase the resistivity of the supplemental carrier, the charge quantity of the carrier decreases although the resistivity thereof increases, resulting in deterioration of reproducibility of images and occurrence of background fouling.

Therefore, in the trickle developing method, it is essential that the carrier can maintain stable chargeability even when used for long periods.

Japanese Published Unexamined Patent Application No. 58-108548 discloses coating a granulated carrier for use in a two-component developer with a proper resin for the purpose of preventing a toner from filming over the carrier, forming a uniform surface thereof, preventing the surface thereof from being oxidized, preventing deterioration of moisture sensitivity thereof, extending a life of the developer, protecting a photoreceptor from being scratched or abraded with the carrier, controlling a charge polarity, adjusting charge quantity, etc; and Japanese Published Examined Patent Applications Nos. 1-19584 and 3-628, and Japanese Published Unexamined Patent Application No. 6-202381 disclose a method of adding various additives to the coated layer.

Further, Japanese Published Unexamined Patent Application No. 5-273789 discloses a carrier, the surface of which an additive adheres to, and Japanese Published Unexamined Patent Application No. 9-160304 discloses a carrier including an electroconductive particulate material larger than the thickness of a coated layer thereof.

Japanese Published Unexamined Patent Application No. 8-6307 discloses using a carrier coating material mainly including a benzoguanamine-n-butylalcohol-formaldehyde copolymer, and Japanese Patent No. 2683624 discloses using crosslinked material between a melamine resin and an acrylic resin as a carrier coating material.

However, even these carriers still have problems in their durabilities or heat resistances, and problems of toner spent on the carrier, unstable charge quantity and foggy images. Further, the environmental resistance needs improvement.

In addition, a resistivity adjuster is conventionally included in a carrier in a two-component developer to have stable chargeability. Carbon black is mostly used as the resistivity adjuster.

However, when such a carrier is used in a color image forming apparatus, the surface of the carrier is abraded or carbon black leaves therefrom and transfers in color images, resulting in possible color contamination.

Various methods are disclosed to prevent this phenomenon.

For example, Japanese Published Unexamined Patent Application No. 7-140723 discloses a carrier wherein an electroconductive material (carbon black) is present on the surface of a core material and not in a coated layer.

Japanese Published Unexamined Patent Application No. 8-179570 discloses a carrier having a concentration gradient of carbon black in its coated layer, wherein the concentration becomes lower toward the surface thereof and carbon black is not present at the surface thereof.

Japanese Published Unexamined Patent Application No. 8-286429 discloses a double-coated carrier wherein an inner coated layer including electroconductive carbon is formed on the surface of a core material and a coated layer including a white electroconductive material is formed thereon.

However, recently, electrophotographic image forming apparatus is noticeably required to from an image at higher speed, and a developer receives stress more and more. Therefore, it is difficult to completely prevent the color contamination caused by transfer of carbon black in images even with the carries disclosed in Japanese Published Unexamined Patent Applications Nos. 7-140723, 8-179570 and 8-286429.

Japanese Published Unexamined Patent Application No. 2001-188388 discloses a carrier including a thin-coated layer having concavities and convexities on the surface thereof. Such a thin-coated layer does not have sufficiently along life. When simply making the coated layer thicker, the surface of the carrier does not have sufficient concavities and convexities to prevent toner spent.

Because of these reasons, a need exists for a carrier stably maintaining the chargeability of a developer, preventing the carrier from adhering to solid images when used long, preventing color image contamination and producing high definition and quality images for long periods.

SUMMARY OF THE INVENTION

Accordingly, an object of the present invention is to provide a carrier stably maintaining the chargeability of a developer, preventing the carrier from adhering to solid images when used long, preventing color image contamination and producing high definition and quality images for long periods.

Another object of the present invention is to provide a supplemental developer using the carrier.

A further object of the present invention is to provide a developer using the carrier, readily contained in an image developer.

Another object of the present invention is to provide a developer feeding apparatus feeding the carrier.

A further object of the present invention is to provide a process cartridge using the carrier.

Another object of the present invention is to provide an image forming apparatus using the carrier.

These objects and other objects of the present invention, either individually or collectively, have been satisfied by the discovery of a carrier for use in an image forming apparatus in which a toner and a carrier are fed to an image developer therein and an extra developer including the toner and carrier is discharged, wherein the carrier fed to the image developer and readily contained therein comprises:

a core material; and a coated film coating the core material, and wherein the coated film comprises a binder resin and a particulate material having a ratio of an average particle diameter thereof to an average thickness of the coated film of from 0.01 to 1, and comprises concavities and convexities having an average difference of elevation of from 0.02 to 3.0 μm.

These and other objects, features and advantages of the present invention will become apparent upon consideration of the following description of the preferred embodiments of the present invention taken in conjunction with the accompanying drawings.

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein:

FIG. 7 is a perspective view illustrating the volume-reduced developer storing container a developer is discharged from.

DETAILED DESCRIPTION OF THE INVENTION

The present invention provides a carrier stably maintaining the chargeability of a developer, preventing the carrier from adhering to solid images when used long, preventing color image contamination and producing high definition and quality images for long periods.

More particularly, the present invention relates to a carrier for use in an image forming apparatus in which a toner and a carrier are fed to an image developer therein and an extra developer including the toner and carrier is discharged, wherein the carrier fed to the image developer and readily contained therein comprises:

a core material; and a coated film coating the core material, and wherein the coated film comprises a binder resin and a particulate material having a ratio of an average particle diameter thereof to an average thickness of the coated film of from 0.01 to 1, and comprises concavities and convexities having an average difference of elevation of from 0.02 to 3.0 μm.

Figure 1:
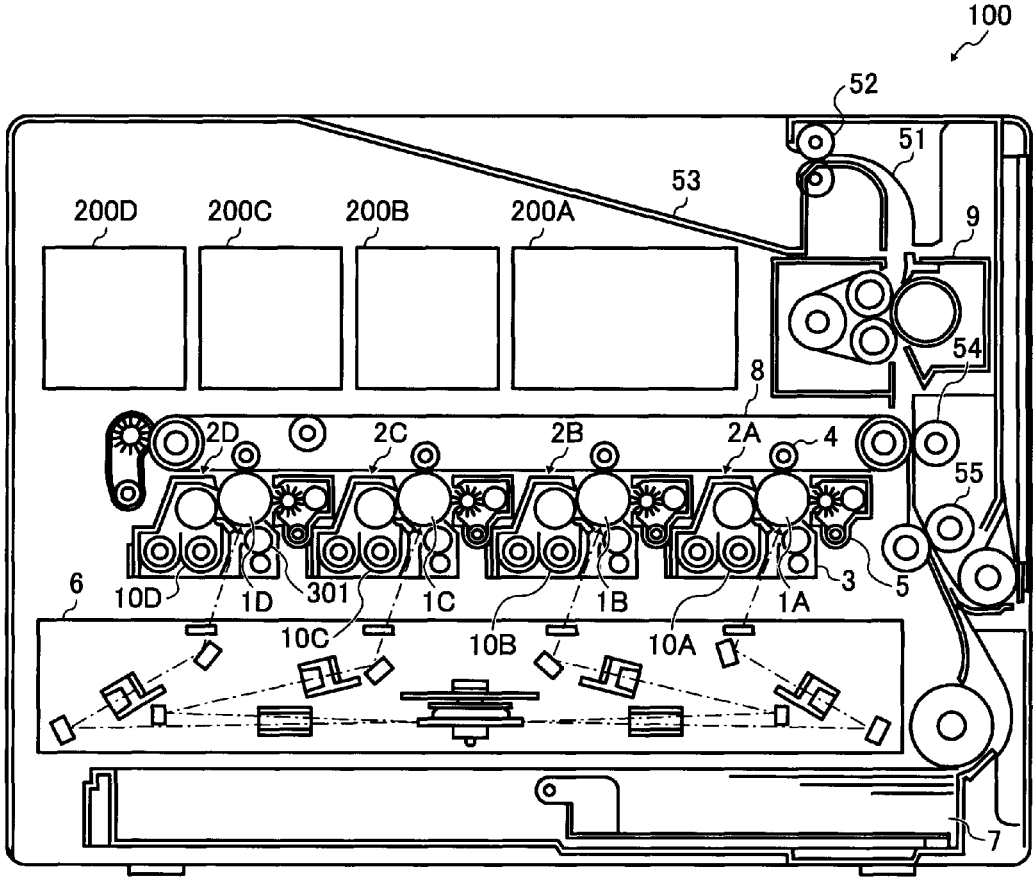
FIG. 1 is a schematic view illustrating an embodiment of the image forming apparatus of the present invention.

FIG. 1 is a schematic view illustrating an embodiment of the image forming apparatus of the present invention.

Four image forming units 2A, 2B, 2C and 2D each having an image bearer which is a photoreceptor 1, i.e., process cartridges are installed in an image forming apparatus 100, detachable therefrom. Almost in the center thereof, a transferer 3 including a transfer belt 15 rotatable in the direction of an arrow A between plural rollers.

Each of the photoreceptors 1 in the image forming units 2A, 2B, 2C and 2D contacts the under surface of the transfer belt 15. The image forming units 2A, 2B, 2C and 2D include image developers 10A, 10B, 10C and 10D using different color toners respectively.

The image forming units 2A, 2B, 2C and 2D have the same constitutions, and the image forming unit 2A forms a magenta color images, 2B forms a cyan color image, 2C forms a yellow color image and 2D forms a black color image.

Each of the image developers 10A, 10B, 10C and 10D uses a two-component developer including a toner and a carrier, and a developer feeding apparatus 200 mentioned later feeds both a toner depending on an output of a toner concentration sensor (not shown) installed in a developer container 14 and a carrier, and discharges an old developer to replace the developer.

Figure 2:
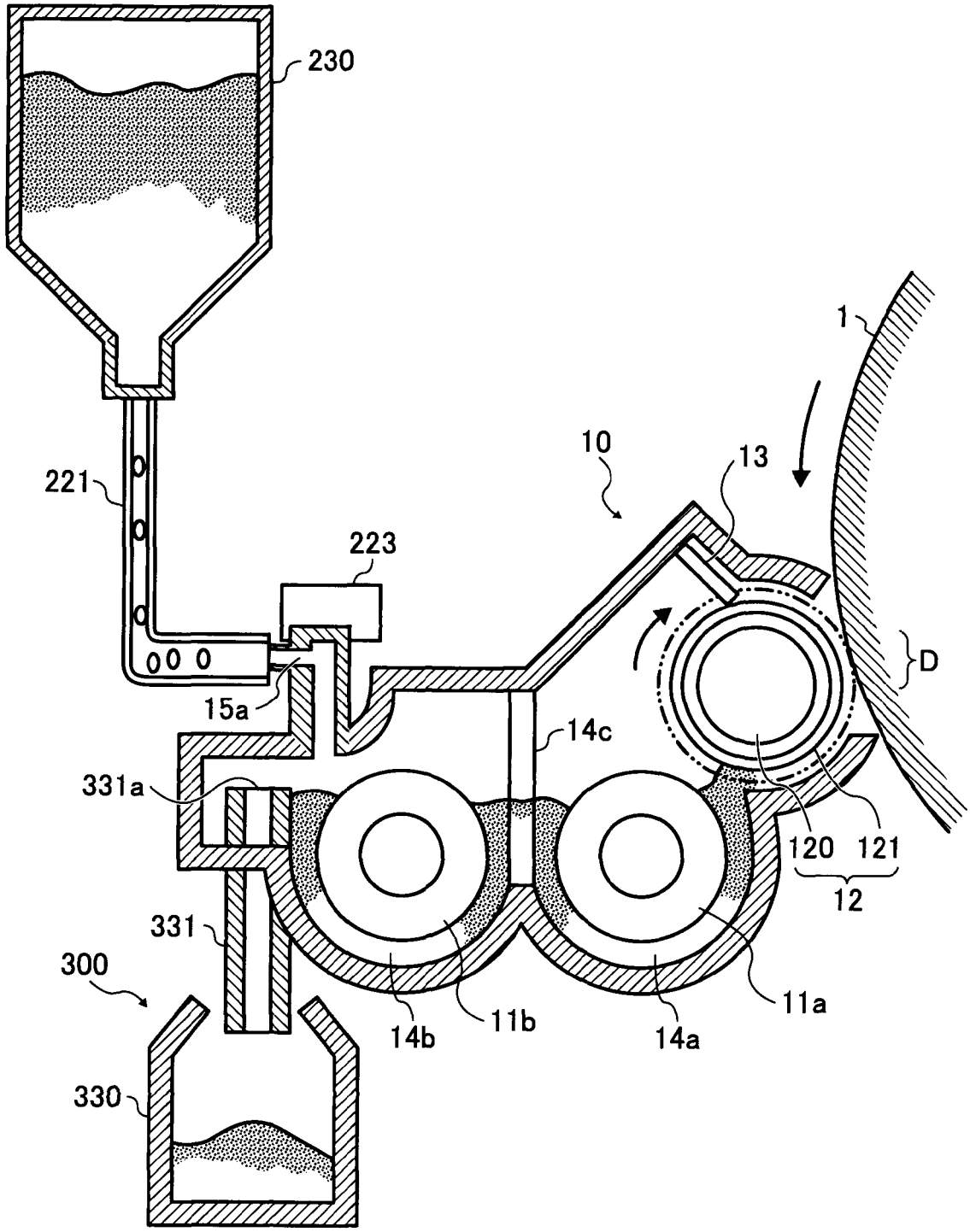
FIG. 2 is a schematic view illustrating a periphery of an embodiment of the image developer for use in the present invention.

Developer feeding apparatuses 200A, 200B, 200C and 200D are located above the image forming units 2A, 2B, 2C and 2D. The developer feeding apparatus 200 feeds a new toner different from a toner fed to the photoreceptor 1 and a new carrier to the image developer 10, the constitution of which is shown in FIG. 2.

An irradiator 6 is located below the image forming units 2A, 2B, 2C and 2D as a writing unit.

The irradiator 6 includes four LD light sources for each color, a polygon scanner including a polygon mirror and a polygon motor, and lenses and mirrors located in each light path, such as fθ lens and long cylindrical lens. A laser beam emitted from the LD is deflected and scanned with the polygon scanner to be irradiated onto the photoreceptor 1.

A fixer 9 fixing a transferred image on a transfer paper is located between the transfer belt 15 and the developer feeding apparatus 200. A paper discharge route 51 is formed downstream of the feeding direction of the transfer paper, and a pair of paper discharge rollers 52 discharge the transfer paper fed through the paper discharge route 51 onto paper tray 53.

The image forming apparatus 100 has a paper feeding cassette 7 at the bottom.

Next, the image forming operation of the image forming apparatus 100 will be explained. When the image forming operation starts, each of the photoreceptors rotates in clockwise direction in FIG. 1. The surface of each photoreceptor 1 is uniformly charged with a charging roller 301 of a charging unit 3. The irradiator 6 irradiates a laser beam including magenta image data to a photoreceptor 1*a* in the image forming unit 2A, a laser beam including cyan image data to a photoreceptor 1*b* in the image forming unit 2B, a laser beam including yellow image data to a photoreceptor 1*c* in the image forming unit 2C and a laser beam including black image data to a photoreceptor 1*d* in the image forming unit 2D to form a latent image including each of the color image data on each of the photoreceptors. When each of the latent images reaches the image developers 10A, 10B, 10C and 10D as the photoreceptor rotates, it is developed with each magenta, cyan, yellow and black color toner to form four colored toner images.

On the other hand, a transfer paper is fed by a separation paper feeder from the paper feeding cassette 7 and transported by a pair of registration rollers 55 located right before the transfer belt 15 such that the toner image formed on each of the photoreceptors 1 is transferred onto the transfer paper. The transfer paper is positively charged by a paper suction roller 52 located close to an entrance of the transfer belt 15 and is electrostatically suctioned to the surface thereof. Then, each magenta, cyan, yellow and black color toner image is sequentially transferred onto the transfer paper suctioned to the transfer belt 15 to form a full-color toner image the four magenta, cyan, yellow and black color toner images are overlapped. The fixer 9 melts and fixes the toner image on the transfer paper upon application of heat and pressure, and then the transfer paper passes through the paper discharge route and is discharged onto the paper tray 53 on the image forming apparatus 1.

Next, the periphery of the image developer will be explained. FIG. 2 is a schematic view illustrating a periphery of an embodiment of the image developer for use in the present invention. In FIG. 2, the developer feeding apparatus 200 feeding a new toner and a carrier into the image developer 10 is located above the image developer, and a developer discharger 300 discharging an excessive developer in the image developer 10 is located below the image developer 10.

The image developer 10 mainly includes a housing 15 having the developer container 14 containing a two-component developer including a toner and a carrier; a developing roller 12 as a developer bearer, rotating close to the photoreceptor 1 at an opening side of the housing 15; a pair of screws 11*a* and 11*b* stirring and transferring the developer, rotating in the developer container 14; and a layer thickness regulator 13 located pressed or close to the surface of the developer roller 12.

The developing roller 12 is a rotatable cylindrical sleeve 121 including a fixed magnet roll 120. The developer container 14 is separated into containing spaces 14*a* and 14*b* adjacent to each other through a dividing wall 14*c*, where the developer is circulated between the containing spaces 14*a* and 14*b* while stirred with screws 11*a* and 11*c*. The layer thickness regulator 13 is formed of a non-magnetic material and a magnetic material and has an end having a polarity reverse to that of the magnet roll 120.

The developer feeding apparatus 200 includes a developer storage 230 storing a supplemental two-component developer and a developer feeder 220 feeding the two-component developer in the developer storage 230 to the developer container 14. The developer feeder 220 is located between the developer storage 230 and the image developer 10 while connected thereto.

Details of the developer feeding apparatus 200 will be explained later, using FIG. 3.

The developer discharger 300 includes a collection container 330 collecting the excessive two-component developer in the developer container 14 and a discharge pipe 331 discharging the excessive developer overflowing from the developer container 14 to the a collection container 330.

The discharge pipe 331 has an opening 331*a* at the top at a specific height in the developer container 14 such that the developer surpassing the opening 331*a* is discharged.

The developer discharger 300 is not limited to the above in the present invention. For example, a developer discharge opening may be located at a specific part of the housing 15, and a discharge screw instead of the discharge pipe 331 may be located close to the developer discharge opening as developer discharge means to discharge the developer into the collection container 330.

In addition, the discharge pipe 331 may include the discharge screw at the end or inside.

The supplemental developer of the present invention includes at least a toner and a carrier.

The toner of the supplemental developer included in the developer storage 230 includes the following toner and the carrier thereof is a magnetic carrier including a specific core material coated with a layer including a specific particulate material.

The toner of the developer in the image developer may be the same toner contained in the developer storage 230 or different therefrom. In addition, the carrier of the developer in the image developer may also be the same carrier contained in the developer storage 230 or different therefrom.

Details of the carrier for use in the present invention will be explained later.

Next, the operation of the image developer will be explained referring to FIG. 2.

The developer readily contained in the developer container 14 is fully mixed by pair of the screws 11*a* and 11*b* to be frictionally charged, and is fed to the developing roller 12 and adhere to the surface of the sleeve 121 as a layer.

The developer adhering to the developing roller 12 is regulated to form a uniform layer and transferred to a developing area D facing the photoreceptor 1 with the rotation of the sleeve 121. At the developing area D, the toner in the two-component developer is electrostatically suctioned to a latent image relevant to an original image, formed on the photoreceptor 1 in the image forming apparatus 100, to form a toner image on the photoreceptor 1.

The toner image formed on the photoreceptor 1 is transferred onto a recording paper in the image forming apparatus 100, and fixed thereon by a fixer.

When the image developing operation is repeated, the developer in the developer container 14 in the image developer is gradually consumed. The increase of the toner is detected by the toner concentration sensor, the developer feeder 220 of the developer feeding apparatus 200 works. The, the supplemental developer including a carrier and a toner contained in a developer storing container 231 of the toner storage 230 is fed into the developer container 14. The new two-component developer fed into the developer container 14 is stirred by the pair of screws 11*a* and 11*b* and fully mixed with the developer readily contained in the image developer.

The amount of the developer in the developer container 14 gradually becomes excessive because a carrier as well as a toner is fed into the developer container 14 from the developer feeding apparatus 200 at a specific ratio. The excessive two-component developer in the developer container 14 surpasses the specific height therein and overflows, and is contained in the collection container 330 through the discharge pipe 331 of the developer discharger 300.

The image forming apparatus 100 of the present invention is equipped with the developer feeding apparatus 200 including the easily-deformable developer storing container 231 filled with the supplemental developer and a screw pump 223 suctioning the supplemental developer to feed suctioning the supplemental developer to the image developer 10.

Hereinafter, the constitution of the developer feeding apparatus 200 will be explained in detail, referring to FIG. 3 to 7.

Figure 3:
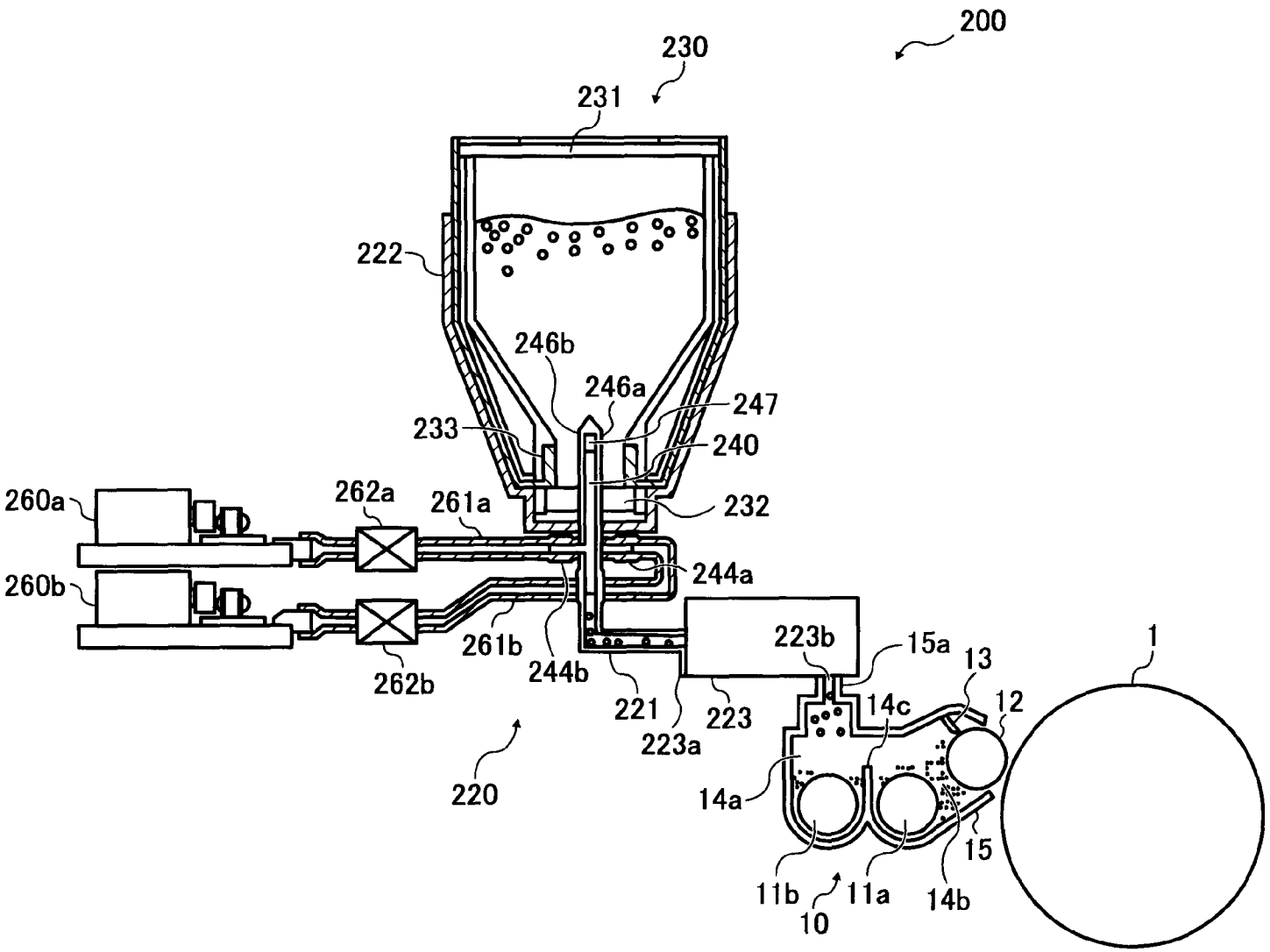
FIG. 3 is a schematic view illustrating an embodiment of the developer feeding apparatus for use in the present invention.

FIG. 3 is a schematic view illustrating an embodiment of the developer feeding apparatus 200 for use in the present invention. The developer storage 230 in the developer feeding apparatus 200 includes the volume-reducible and bag-shaped developer storing container 231. The new supplemental developer fed into the developer container 14 of the image developer 10 is contained in the developer storing container 231. The developer storing container 231 reduces its volume with an inner pressure reduction when the developer therein is fed into the developer container 14.

The developer feeder 220 includes a screw pump 223 connected to a feeding port 15*a* located at a specific part of the housing 15, a nozzle 240 connected to the screw pump 223 and an air feeder 260 connected to the nozzle 240, which work depending on a detected signal from the toner concentration sensor (not shown) in the developer container 14 and feed an appropriate amount of the developer into the developer container 14 from the developer storage 230.

A tube 221 which is a traveling route of the developer is located between the screw pump 223 and the nozzle 240. The tube 221 is preferably formed of a flexible rubber material suitable for a toner, such as polyurethane, nitrile and EPDM.

The developer feeding apparatus 200 has a container holder 222 holding the developer storage 230, and the container holder 222 is formed of a material having high rigidity.

The developer storage 230 has the bag-shaped developer storing container 231 formed of a flexible sheet material and a cap 232 forming a developer outlet.

Materials for the developer storing container 231 are not particularly limited, and preferably have good dimensional accuracy. For example, resins such as a polyester resin, a polypropylene resin, a polystyrene resin, a polyvinylchloride resin, a polyacrylic resin, a polycarbonate resin, an ABS resin and a polyacetal resin are preferably used.

The cap 232 includes a seal material 233 formed of a sponge or a rubber, and the seal material 233 has a cross cut. The nozzle 240 of the developer feeder 220 passes through the cut such that the developer storage 230 and the developer feeder 220 are fixedly connected to each other.

In this embodiment, the cap 232 is located below the developer storage 230. The location of the cap 232 is not limited thereto, and may horizontally or obliquely be located relative to the developer storage 230.

The developer storage is timely replaced with a new one with the consumption of the toner, and the developer storage 230 in this embodiment is easily detachable and prevents the toner from leaking when replaced or used.

The size, shape, structure and material of the developer storing container 231 are not particularly limited and can suitably be selected in compliance with the purpose.

The developer storing container 231 preferably has the shape of a cylinder, and a spirally-shaped groove is preferably formed on the inner circumferential surface thereof. The spirally-shaped groove smoothly transfer the toner contained in the developer storing container 231 to the outlet when the developer storage 230 rotates. Further, it is more preferable that the developer storing container 231 has the spirally-shaped groove partially or entirely having an accordion function.

The developer storage 230 is easily detachable from the developer feeding apparatus 200 of the image forming apparatus 100, and has good storage ability, transportability and handleability.

Figure 4A:
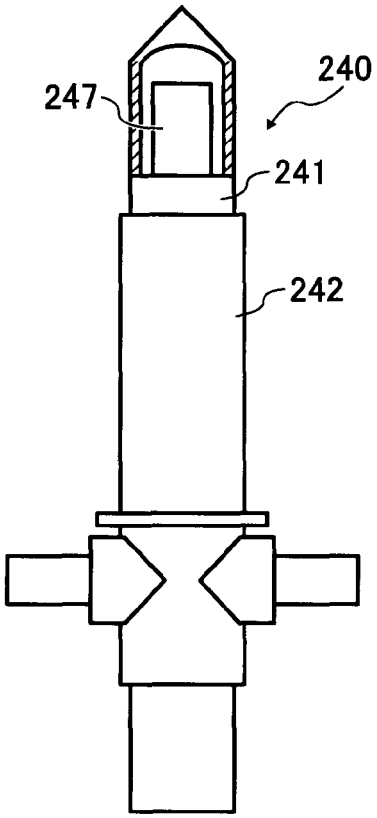
FIG. 4A is a schematic view illustrating a nozzle in the developer feeding apparatus, 4B is a schematic view illustrating a longitudinal section thereof and 4C is a schematic view illustrating a cross-section of a part indicated with A in 4B.

FIG. 4A is a schematic view illustrating the nozzle 240 in the developer feeder 220, 4B is a schematic view illustrating a longitudinal section thereof and 4C is a schematic view illustrating a cross-section of a part indicated with A in 4B.

Figure 4B:
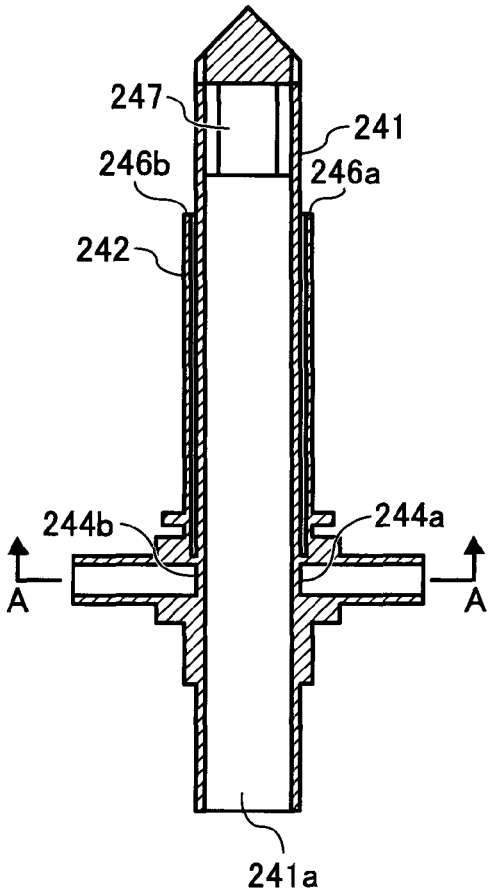

The nozzle 240 has a double-tube structure formed of an outer tube 242 including an inner tube 241 as FIG. 4B shows. The inner tube 241 has a developer flow channel 241*a* for discharging the developer in the developer storage 230. The toner in the developer storage 230 is suctioned in the screw pump 223 through the developer flow channel 241*a*.

Figure 5:
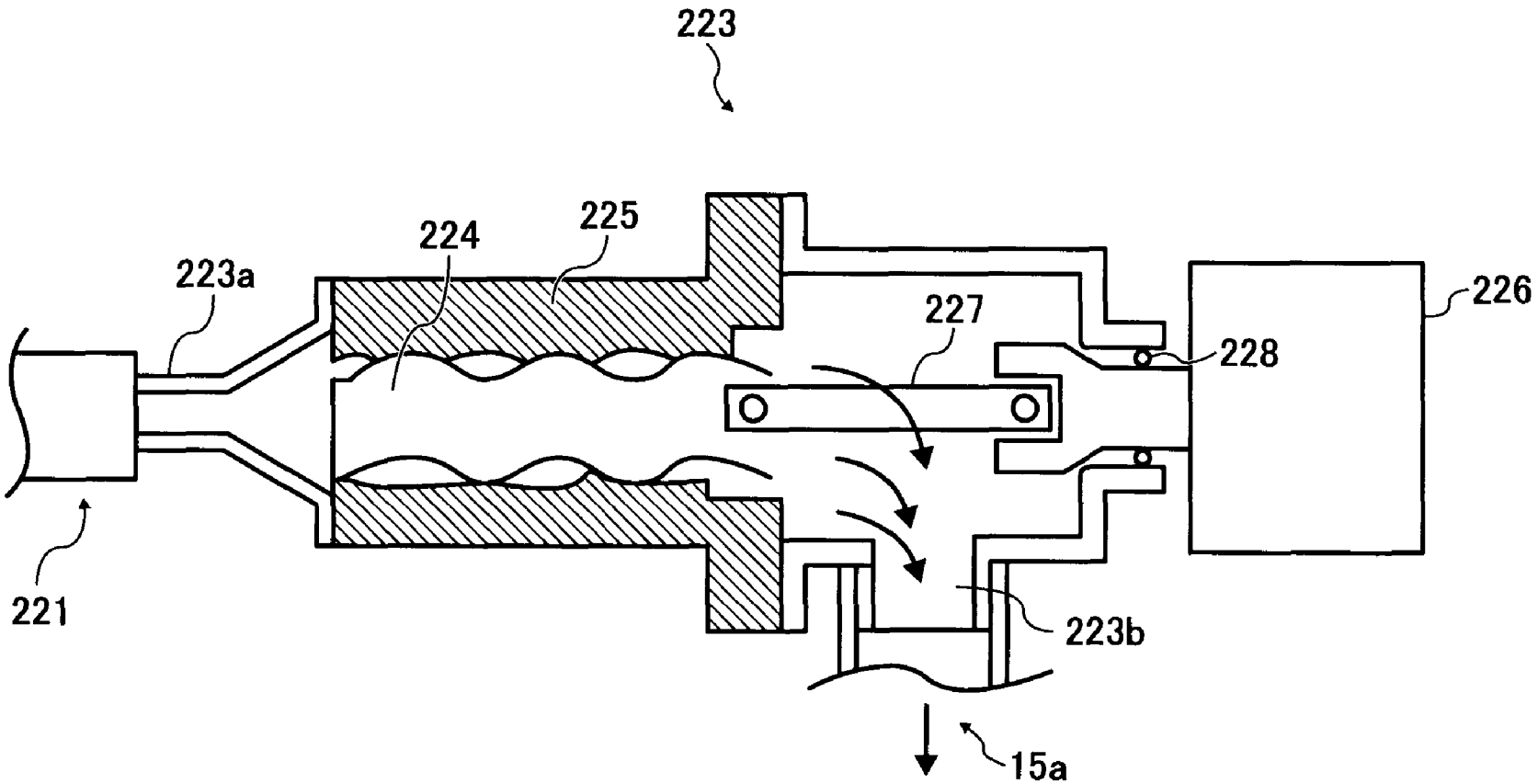
FIG. 5 is a schematic view illustrating a cross-section of a screw pump in the developer feeding apparatus.

FIG. 5 is a schematic view illustrating a cross-section of the screw pump 223. The screw pump 223 is a uniaxial eccentric screw pump including a rotor 224 and a stator 225. The rotor 224 is formed of a spirally-twisted hard material and is engaged in the stator 225. The stator 225 is formed of a flexible rubber material and has a spirally-twisted hole the rotor 224 is engaged in. The stator 225 has a spiral pitch twice as long as that of the rotor 224. The rotor 224 is connected to a drive motor 226 through a universal joint 227 and a bearing 228.

The toner and carrier fed from the developer storage 230 through the developer flow channel 241*a* of the nozzle 240 and the tube 221 enters the screw pump 223 through an inlet 223*a* thereof. Then, the toner and carrier enter a space formed between the rotor 224 and the stator 225, and are transferred to the right in FIG. 3 with the rotation of the rotor 224. The toner passed the space between the rotor 224 and the stator 225 falls below from a toner vent 223*b* and is fed into the image developer 10 through the feeding port 15*a*.

The developer feeder 220 includes the air feeder 260 feeding air into the developer storage 230.

As FIG. 3 shows, air flow channels 244*a* and 244*b* are connected to the air pumps 260*a* and 260*b* through air feeding routes 261*a* and 261*b* respectively.

Figure 4C:
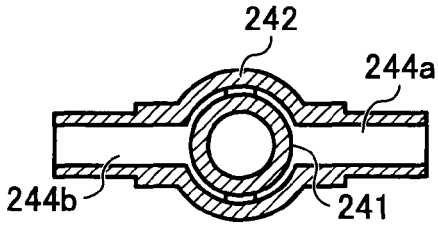

As FIG. 4B shows, the airflow channel 244 is located between the inner tube 241 and the outer tube 242 of the nozzle 240 in the developer feeder 220, and is formed of two flow channels 244*a* and 244*b* each having a half circle cross-section independent on each other as FIG. 4C shows.

The air pumps 260*a* and 260*b* may be typical diaphragm air pumps. The air fed from the air pumps 260*a* and 260*b* pass the air flow channels 244*a* and 244*b* respectively and are fed into the developer storage 230 from air feeding openings 246*a* and 246*b*. The air feeding openings 246*a* and 246*b* are located below a developer outlet 247 of the developer flow channel 241*a*. Therefore, even when the toner blocks the developer outlet 247 after being unused for long periods, the air fed from the air feeding openings 246*a* and 246*b* blow up the toner blocking the developer outlet 247.

The air feeding routes 261*a* and 261*b* has on-off valves 262*a* and 262*b* opening and closing depending on a control signal from a controller (not shown). The on-off valves 262*a* and 262*b* open valves to pass the air when receiving an on signal and close vales to block the air when receiving an off signal.

Next, the operation of the developer feeder 220 will be explained referring to FIG. 3.

When the controller receives a signal informing the toner concentration is short from the image developer 10, the developer feeding operation starts. First, the air pumps 260*a* and 260*b* are activated to feed air into the developer storage 230, and the drive motor 226 is driven for activating the screw pump 223 to suction the developer.

The air fed from the air pumps 260*a* and 260*b* enters the air flow channels 244*a* and 244*b* through the air feeding routes 261*a* and 261*b* and is fed into the developer storage 230 through the air feeding openings 246*a* and 246*b*. The air stirs the developer in the developer storage 230 such that the developer includes much air to have more fluidity.

When the air is fed into the developer storage 230, a pressure therein increases. Therefore, a pressure difference arises between an inner pressure of the developer storage 230 and an outer pressure (atmospheric pressure), and the fluidized developer transfers to a place having lower pressure. Accordingly, the developer in the developer storage 230 flows out from the developer outlet 247.

In this embodiment, the suction of the screw pump 223 helps the developer in the developer storage 230 flow out from the developer outlet 247.

The developer flowed out from the developer storage 230 passes through the developer flow channel 241*a* of the nozzle 240 from the developer outlet 247 and transfers in the screw pump 223 through the tube 221. Transferring in the screw pump 223, the developer falls below from the toner vent 223*b* and is fed into the image developer 10 through the feeding port 15*a*.

Completing feeding a specific amount of the developer, the controller stops the operations of the air pumps 260*a*, 260*b* and the drive motor 226, and closes the on-off valves 262*a* and 262*b* to finish feeding the developer. The on-off valves 262*a* and 262*b* are closed to prevent the developer in the developer storage 230 from flowing backward to the air pumps 260*a* and 260*b* through the air flow channels 244*a* and 244*b* of the nozzle 240.

Amount of the air fed from the air pumps 260*a* and 260*b* is smaller than a suction amount of the developer and air with the screw pump 223. Therefore, as the developer is consumed, the inner pressure of the developer storage 230 decreases. Accordingly, the developer storing container 231 formed of a flexible sheet material in the developer storage 230 reduces its volume with decrease of the inner pressure.

Figure 6:
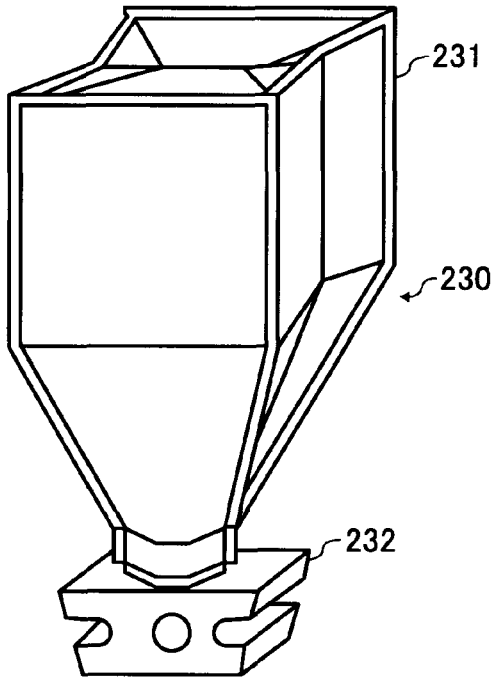
FIG. 6 is an oblique perspective view illustrating a developer storing container filled with a developer.

FIG. 6 is an oblique perspective view illustrating the developer storing container 231 filled with a developer.

Figure 7:
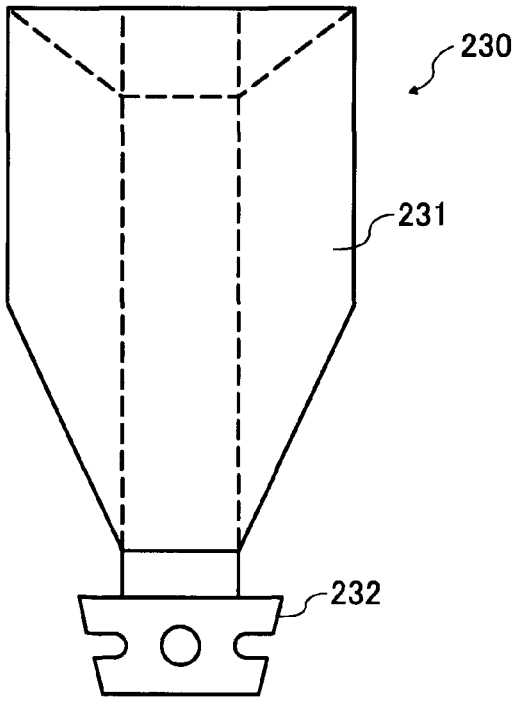

FIG. 7 is a perspective view illustrating the volume-reduced developer storing container 231 the developer is discharged from. The developer storing container 231 preferably reduces its volume by not less than 60%.

The developer storing container 231 in the developer storage 230 in FIG. 6 contains the supplemental developer including a carrier and a toner to be fed to the image developer 10.

The supplemental developer preferably includes the carrier in an amount of from 3% to 30% by weight.

When less than 3% by weight, the carrier is not sufficiently fed to the image developer 10. When greater than 30% by weight, the supplemental developer is not stably provided to the developer storage 230.

Next, the toner and the carrier included in the supplemental developer and the developer readily contained in the image developer will be explained.

The carrier of the present invention preferably comprises a core material and a coated film comprising a binder resin and a particulate material and covering the core material, wherein a ratio (D/h) of an average particle diameter (D) of the particulate material to an average thickness (h) of the coated film is from 0.01 to 1. This is why the carrier has good durability and is capable of preventing adherence thereof. When the ratio (D/h) is larger than 1, when images having a low image area are continuously produced, the convexities of the particulate materials are abraded and the resistivity of the carrier lowers, resulting in deterioration of the image quality. When less than 0.01, the carrier scarcely has the concavities and convexities of the particulate materials, and has a flat surface. Therefore, a toner sticking thereto deteriorates the chargeability thereof, resulting in deterioration of image quality.

The thickness (h) of the coated film is an average thickness of a resin covering the surface of the carrier, which is measured by observing the cross-section thereof with a transmission electron microscope (TEM). Specifically, 50 distances from the surface of the carrier to the surface of the coated layer are measured and a difference between an average of the major 5 values and an average of minor 5 values is determined to be the thickness (h) μm.

The average particle diameter (D) of the particulate material is measured as follows:

placing 30 ml of amino silane (SH6020 from Dow Corning Toray Silicone Co., Ltd.) and 300 ml of toluene in a juicer-mixer; placing 6.0 g of a sample therein;

dispersing the mixture in the juicer-mixer at a low speed to prepare a dispersion;

placing the dispersion in 500 ml of toluene in a beaker having a capacity of 1,000 ml to be diluted to prepare a dilution; and measuring the volume-average particle diameter of the sample by a centrifugal automatic particle diameter distribution measurer CAPA-700 from Horiba, Ltd. while stirring the dilution constantly by a homogenizer under the following conditions:

rotation speed: 2,000 rpm
maximum particle diameter: 2.0 μm
minimum particle diameter: 0.1 μm
particle diameter interval: 0.1 μm
dispersion medium viscosity: 0.59 mPa·s
dispersion medium density: 0.87 g/CM$^3$ particle density: the density of the in organic particulate material is an absolute specific gravity measured by a dry automatic bulk density meter ACUPIC 1330 from Shimadzu Corporation.

The carrier of the present invention has an average difference of elevation of from 0.02 to 3.0 μm, and preferably from 0.05 to 2.0 μm. When larger than 3.0 μm, a toner tends to be firmly fixed on the concavities and chargeability of the carrier deteriorates. In addition, the particulate materials forming convexities separate therefrom and the resistivity thereof deteriorates. When less than 0.02 μm, a toner is less scraped off from the carrier and firmly fixed thereon, resulting in deterioration of chargeability thereof. The average difference of elevation is an average difference of elevation of a resin covering the surface of the carrier, which is measured by observing the cross-section thereof with a transmission electron microscope. Specifically, 50 distances from the surface of the carrier to the surface of the coated layer are measured, and a difference between an average of the maximum 5 distances and an average of the minimum 5 distances is determined to be the average difference of elevation.

When the carrier of the present invention is observed by a scanning electron microscope, the carrier is proved to have concavities and convexities and include the particulate materials. Compared with when D/h is larger than 1, the carrier has less convexities of the particulate materials and a smaller difference of elevation of the concavities and convexities. However, the convexities thereof are difficult to abrade even when producing images having a low image area because the average thickness of the coated film is thick, and deterioration of the resistivity thereof can be prevented.

The core material of the present invention includes known materials, and is not particularly limited, such as ferrite, Cu—Zn-ferrite, Mn ferrite, Mn—Mg-ferrite, Mn-MG-Sr ferrite, magnetite iron and nickel. Suitable materials can be selected in accordance with the applications of the carrier. For example, MFL-35S (from POWDERTECH CO., LTD.), MFL-35HS (from POWDERTECH CO., LTD.), DFC-400M (from DOWA IRON POWDER CO., LTD.), etc. are available, but the suitable materials are not limited thereto. The core material preferably has an average particle diameter of from 20 to 65 μm. When less than 20 μm, the carrier tends to adhere to an electrostatic latent image bearer. When larger than 65 μm, deterioration of image quality such as a carrier stripe tends to occur.

The particulate material is preferably from 10 to 80% by weight, and more preferably from 40 to 70% by weight based on total weight thereof and the binder resin. When less than 10% by weight, a strong stress to the binder resin cannot effectively be reduced. When greater than 80% by weight, the chargeability of the carrier deteriorates and the particulate material is insufficiently maintained.

The content of the particulate material (% by weight)= [the particulate material/(the particulate material+total weight of the solid content of a coated resin)]

A ratio (hereinafter referred to as a coverage of the particulate material) of a product of the cross-section area of the particulate material and the number thereof to a product of the surface area of the core material and the number thereof is preferably from 0.3 to 30. This is why the particulate materials properly stack in the coated film to strengthen the coated film. Therefore, the coated film less separates from the core material and is less abraded, and the carrier has stable quality. When the coverage of the particulate material is less than 0.3, a toner sticking to the carrier is not effectively prevented. When greater than 30, the chargeability of the carrier deteriorates and the particulate material is insufficiently maintained.

The coverage of the particulate material can be determined by the following formula:

$$\text{The coverage of the particulate material}=(Ds\times\rho s\times W)/(4\times Df\times\rho f)$$

wherein Ds is an average particle diameter of the core material, ρs is an absolute specific gravity thereof, W is a weight ratio of the particulate material to the core material, Df is an average particle diameter of the particulate material and ρf is an absolute specific gravity thereof. Namely, the surface area of the core material is a surface area of a sphere having the particle diameter Ds. The number of the core material is a weight ratio of the core material to the weight of a sphere having the diameter Ds and the absolute specific gravity ρs. The cross-section area of the particulate material is the area of a circle having the diameter Df. The number of the particulate material is a weight ratio of the particulate material to the weight of a sphere having the diameter Df and the absolute specific gravity ρf. The average particle diameter of the core material can be measured similarly to the average particle diameter (D) of the particulate material.

The carrier of the present invention preferably has a volume resistivity of from $1\times10^{10}$Ω·cm to $1\times10^{17}$Ω·cm. When less than $1\times10^{10}$Ω·cm, the carrier tends to adhere to non-image areas. When greater than $1\times10^{17}$Ω·cm, the edge effect deteriorates. When less than the minimum resistivity measurable by a high resist meter, the carrier substantially has no volume resistivity and is considered to be broken down.

Figure 8:
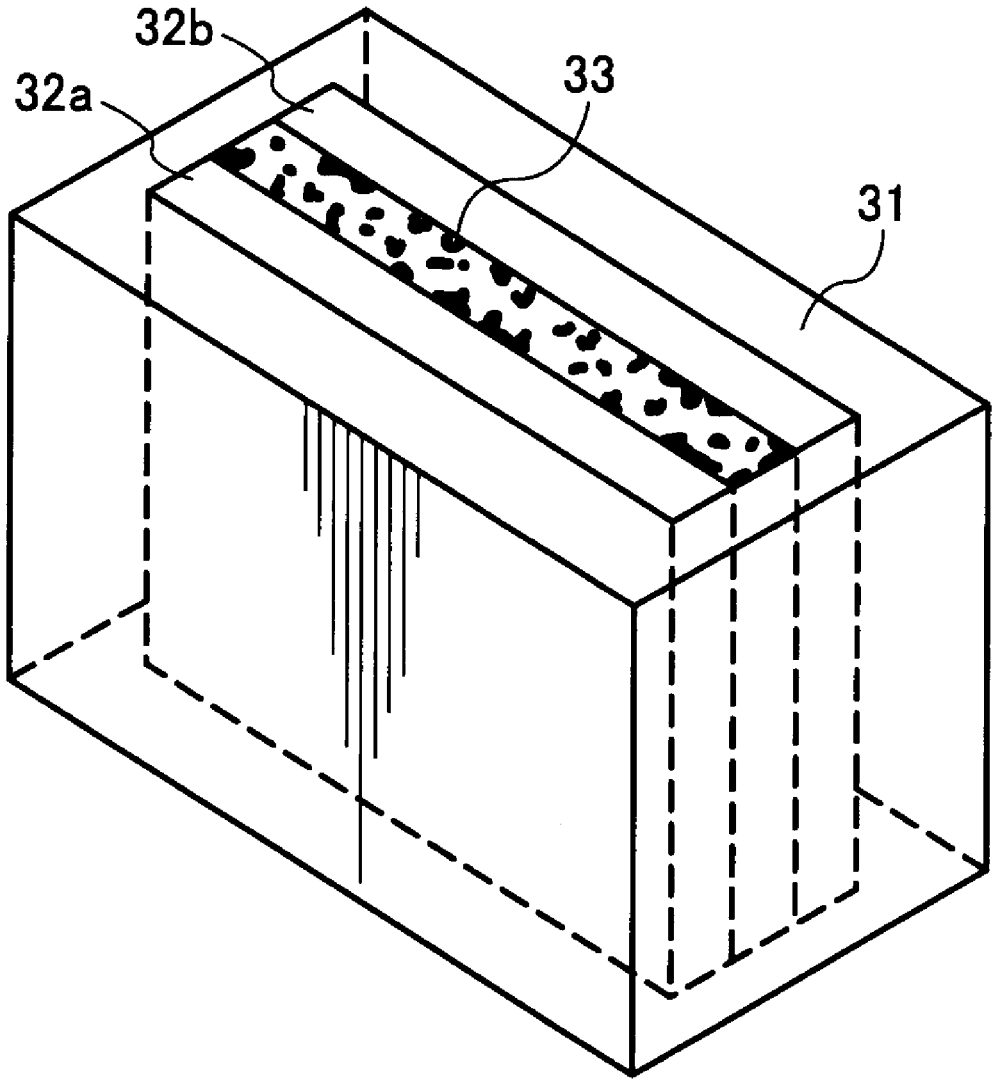
FIG. 8 is a schematic view illustrating a powder resistivity measurer for use in the present invention.

The volume resistivity is measured as follows:

filling a carrier 33 in a cell 31 formed of a fluorine-containing resin containing electric poles 32 and 32*b* having a surface area of 2 cm×4 cm respectively and a gap of 2 mm therebetween as shown in FIG. 8;

tapping the cell 31 by a tapping machine PTM-1 from SANKYO PIO-TECH. CO., Ltd. at 30 times/min for 1 min;

applying a DC voltage of 1,000 V between the electric poles; and measuring a DC resistance by a high resistance meter 4329A from YOKOKAWA HEWLETT PACKARD LTD to determine an electric resistance R Ω·cm and Log R.

The particulate material is not particularly limited, and preferably an inorganic particulate material such as zinc and valium. Particularly, alumina, silica or titanium is more preferably used.

The coated film covering the carrier of the present invention preferably has an average thickness of from 0.05 to 4.00 μm, and more preferably from 0.05 to 1.00 μm. When less than 0.05 μm, the convexities of the particulate materials are scraped or the core material is exposed due to insufficient thickness, resulting in deterioration of the resistivity of the carrier. When thicker than 4.00 μm, the carrier becomes large, resulting in deterioration of chargeability and image definition.

The binder resin preferably has a glass transition temperature of from 20 to 100° C. This is why the binder resin has a suitable elasticity and contact stresses between a toner and the carrier or the carriers when stirred to frictionally charge a developer can be absorbed. When lower than 20° C., blocking problems tend to occur. When higher than 100° C., the binder resin deteriorates in capability of absorbing stress and tends to be abraded.

The glass transition temperature is specifically determined by the following steps. TA-60WS and DSC-60 from Shimadzu Corporation are used to measure the glass transition temperature under the following conditions.

Sample container: Sample pan made of aluminum (with a lid)

Sample amount: 5 mg

Reference: Sample pan made of aluminum (10 mg of alumina)

Atmosphere: Nitrogen (flow rate 50 ml/min)

Starting temperature: 20° C.

Rising speed of temperature: 10° C./min

Maximum temperature: 150° C.

Holding time: 0

Lowering speed of temperature: 10° C./min

Minimum temperature: 20° C.

Holding time: 0

Rising speed of temperature: 10° C./min

Maximum temperature: 150° C.

The measurement results are analyzed using data analysis software TA-60 version 1.52 from Shimadzu Corporation. A range of ±5° C. is specified with a central focus on a maximum peak point on the lowest temperature side of a DSC differential curve in the second rise of temperature, and a peak temperature is determined using a peak analysis function of the analysis software. Next, the maximum endothermic temperature is determined of the DCS curve using the peak analysis function of the analysis software in the range of the peak temperature ±5° C. This is the glass transition temperature.

The carrier of the present invention preferably has a weight-average particle diameter of from 20 to 65 μm. When less than 20 μm, the carrier deteriorates in uniformity and tends to have adherence thereof. When larger than 65 μm, reproducibility of image details deteriorates and high-definition images are hard to produce. The weight-average particle diameter of a carrier can be measured by SRA type of MICROTRAC particle size analyzer measuring a range of from 0.7 to 125 μm from NIKKISO CO., LTD., wherein methanol is used as a dispersion liquid and a refractive index thereof is set at 1.33 and those of the carrier and core material are set at 2.42.

The binder resin is preferably a silicone resin. Having a low surface energy, the silicone resin can prevent a toner from sticking.

Specific examples of the silicone resin include any known silicone resins such as straight silicones and silicones modified with a resin such as an alkyd resin, a polyester resin, an epoxy resin, an acrylic resin and a urethane resin. Specific examples of marketed products of the straight silicones include, but are not limited to, KR271, KR255 and KR152 from Shin-Etsu Chemical Co., Ltd; and SR2400, SR2406 and SR2410 from Dow Corning Toray Silicone Co., Ltd. The straight silicone resins can be used alone, and a combination with other constituents crosslinking therewith or charge controlling constituents can also be used. Specific examples of the modified silicones include, but are not limited to, KR206 (alkyd-modified), KR5208 (acrylic-modified), ES1001N (epoxy-modified) and KR305 (urethane-modified) from Shin-Etsu Chemical Co., Ltd; and SR2115 (epoxy-modified) and SR2110 (alkyd-modified) from Dow Corning Toray Silicone Co., Ltd.

The binder resin preferably includes an acrylic resin. Having strong adhesiveness and low brittleness, the acrylic resin stably maintains the coated film, preventing the coated film from being abraded and separating. Further, the particulate material included therein is strongly maintained, particularly when having a particle diameter larger than the average thickness thereof.

Specific examples of the acrylic resin include known acrylic resins. The acrylic resin can be used alone, and a combination with at least one other constituent crosslinking therewith can also be used. Specific examples of the other constituent crosslinking therewith include amino resins such as guanamine and a melamine resin; and acidic catalysts. Specific examples of the acidic catalysts include any materials having a catalytic influence, e.g., materials having a reactive group such as a complete alkyl group, a methylol group, an imino group and a methylol/imino group.

The binder resin preferably includes an acrylic resin and a silicone resin. Since the acrylic resin has a high surface energy, a toner tends to stick to the carrier and accumulate thereon, resulting in deterioration of charge quantity thereof. The silicone resin having a low surface energy solves this problem when used with the acrylic resin. It is important to balance the properties of the two resins because the silicone resin has low adhesiveness and high brittleness. Then, a toner is difficult to stick to the coated film, and which has good abrasion resistance.

The binder resin is preferably from 0.1% to 1.5% by weight based on total weight thereof and the core material. When less than 0.1% by weight, the coated film does not sufficiently work. When greater than 1.5% by weight, the coated film is more abraded.

The carrier of the present invention preferably has a magnetization of from 40 $Am^2/kg$ to 90 $Am^2/kg$ at 1,000 Oe, when gaps between the carriers are suitably maintained and a toner is smoothly dispersed with the carrier in a developer. When less than 40 A $m^2/kg$ at 1,000 Oe, the carrier adherence tends to occur. When greater than 90 A $m^2/kg$, an ear (magnetic brush) of the developer when developing becomes hard, resulting in deterioration of reproducibility of image details. The magnetization can be measured as follows:

placing 1.0 g of the carrier core material in a cylindrical cell having an inner diameter of 7 mm and a height of 10 mm;

setting the cell in a B-H tracer BHU-60 from Riken Denshi Co., Ltd.;

increasing a (first) magnetic field gradually to 3,000 Oe and decreasing the magnetic field gradually to 0; increasing an opposite magnetic field gradually to 3,000 Oe and decreasing the magnetic field gradually to 0; and applying a magnetic field again to the same direction of the (first) magnetic field to prepare a B-H curve, from which the magnetization at 1,000 Oe is determined.

Most of degraded carriers in the image developer 10 are discharged developer discharger 300. However, the degraded carriers partially remain in the developer container 14 for long periods, and when the image forming apparatus 100 consumes the toner less, the carrier is exchanged less in the developer container 14 and possibly remains therein longer.

In this embodiment, the developer storage 230 contains the above-mentioned carrier. In the image forming apparatus 100, a supplemental developer including the carrier is fed into the developer container 14 from the developer storage 230.

The toner and the carrier fed in the developer container 14 are mixed with a toner and a carrier readily contained therein with the screws 11*a* and 11*b*. Then, the toner and carrier, or the carrier and carrier contact each other, and the surface of the carrier is possibly abraded with the friction.

The coated film covering the carrier of the present invention has an average thickness (difference in height of concavities and convexities) of from 0.05 to 4.00 μm due to the particulate materials dispersed therein. Therefore, when even the toner or other carriers contact the carrier, the convexities cushion the shock. Accordingly, the surface of the carrier is much less abraded. In addition, a toner adhering thereto is scarped with the convexities, and therefore the developer in the developer container 14 has more stable chargeability.

The developer container 14 readily contains the same carrier as that of the supplemental developer before fed therein from the developer storage 230.

Therefore, even when the developer is exchanges less or the developer readily contained in the developer container 14 partially remain therein without being discharged therefrom, the carrier therein degrades less and has stable chargeability even after used for long periods.

The toner included in the supplemental developer and the image developer includes at least a binder resin and a colorant, and optionally other components such as a release agent and a charge controlling agent.

Methods of preparing the toner are not particularly limited, and can be selected in accordance with the purpose, such as a pulverization method; and a suspension polymerization method, an emulsion polymerization and a polymer suspension method wherein an oil phase is emulsified, suspended or aggregated in an aqueous medium to prepare a parent toner.

Specific examples of the binder resin include any known resins such as homopolymers of styrene and its derivatives such as polystyrene, poly-p-chlorostyrene and polyvinyltoluene; copolymers of styrene such as a styrene-p-chlorostyrene copolymer, a styrene-propylene copolymer, a styrene-vinyltoluene copolymer, a styrene-methyl acrylate copolymer, a styrene-ethyl acrylate copolymer, a styrene-methacrylic acid copolymer, a styrene-methyl methacrylate copolymer, a styrene-ethyl methacrylate copolymer, a styrene-butyl methacrylate copolymer, a styrene-α-chloro methyl methacrylate copolymer, a styrene-acrylonitrile copolymer, styrene-vinyl methyl ether copolymer, a styrene-vinyl methyl ketone copolymer, a styrene-butadiene copolymer, styrene-isoprene copolymer, a styrene-maleate copolymer; a polymethyl methacrylate resin, a polybutyl methacrylate resin, a polyvinylchloride resin, a polyethylene resin, a polyester resin, a polyurethane resin, an epoxy resin, a polyvinylbutyral resin, a polyacrylic acid resin, a rosin resin, a modified rosin resin, a terpene resin, a phenol resin, an aliphatic or aromatic hydrocarbon resin, an aromatic petroleum resin, etc. These can be used alone or in combination.

Specific examples of the colorant for use in the present invention include any known dyes and pigments such as carbon black, Nigrosine dyes, black iron oxide, NAPHTHOL YELLOWS, HANSA YELLOW (10G, 5G and G), Cadmium Yellow, yellow iron oxide, loess, chrome yellow, Titan Yellow, polyazo yellow, Oil Yellow, HANSA YELLOW (GR, A, RN and R), Pigment Yellow L, BENZIDINE YELLOW (G and GR), PERMANENT YELLOW (NCG), VULCAN FAST YELLOW (5G and R), Tartrazine Lake, Quinoline Yellow Lake, ANTHRAZANE YELLOW BGL, isoindolinone yellow, red ironoxide, red lead, orange lead, cadmium red, cadmium mercury red, antimony orange, Permanent Red 4R, Para Red, Fire Red, p-chloro-o-nitroaniline red, Lithol Fast Scarlet G, Brilliant Fast Scarlet, Brilliant Carmine BS, PERMANENT RED (F2R, F4R, FRL, FRLL and F4RH), Fast Scarlet VD, VULCAN FAST RUBINE B, Brilliant Scarlet G, LITHOL RUBINE GX, Permanent Red F5R, Brilliant Carmine 6B, Pigment Scarlet 3B, Bordeaux 5B, Toluidine Maroon, PERMANENT BORDEAUX F2K, HELIO BORDEAUX BL, Bordeaux 10B, BON MAROON LIGHT, BON MAROON MEDIUM, Eosin Lake, Rhodamine Lake B, Rhodamine Lake Y, Alizarine Lake, Thioindigo Red B, Thioindigo Maroon, Oil Red, Quinacridone Red, Pyrazolone Red, polyazo red, Chrome Vermilion, Benzidine Orange, perynone orange, Oil Orange, cobalt blue, cerulean blue, Alkali Blue Lake, Peacock Blue Lake, Victoria Blue Lake, metal-free Phthalocyanine Blue, Phthalocyanine Blue, Fast Sky Blue, INDANTHRENE BLUE (RS and BC), Indigo, ultramarine, Prussian blue, Anthraquinone Blue, Fast Violet B, Methyl Violet Lake, cobalt violet, manganese violet, dioxane violet, Anthraquinone Violet, Chrome Green, zinc green, chromium oxide, viridian, emerald green, Pigment Green B, Naphthol Green B, Green Gold, Acid Green Lake, Malachite Green Lake, Phthalocyanine Green, Anthraquinone Green, titanium oxide, zinc oxide, lithopone, etc.

These materials are used alone or in combination.

The toner preferably include the colorant in an amount of from 1 to 15% by weight, and more preferably from 3 to 10% by weight.

The colorant for use in the present invention can be used as a masterbatch pigment combined with a resin. Specific examples of the resin include, but are not limited to, styrene polymers or substituted styrene polymers, styrene copolymers, a polymethyl methacrylate resin, a polybutylmethacrylate resin, a polyvinyl chloride resin, a polyvinyl acetate resin, a polyethylene resin, a polypropylene resin, a polyester resin, an epoxy resin, an epoxy polyol resin, a polyurethane resin, a polyamide resin, a polyvinyl butyral resin, an acrylic resin, rosin, modified rosins, a terpene resin, an aliphatic or an alicyclic hydrocarbon resin, an aromatic petroleum resin, chlorinated paraffin, paraffin waxes, etc. These resins are used alone or in combination.

Waxes are preferably used as the release agent.

Specific examples of the wax include known waxes, e.g., polyolefin waxes such as polyethylene wax and polypropylene wax; long chain carbon hydrides such as paraffin wax and sasol wax; and waxes including carbonyl groups.

Among these waxes, the waxes including carbonyl groups are preferably used. Specific examples thereof include polyesteralkanate such as carnauba wax, montan wax, trimethylolpropanetribehenate, pentaelislitholtetrabehenate, pentaelislitholdiacetatedibehenate, glycerinetribehenate and 1,18-octadecanedioldistearate; polyalkanolesters such as tristearyltrimellitate and distearylmaleate; polyamidealkanate such as ethylenediaminebehenylamide; polyalkylamide such as tristearylamidetrimellitate; and dialkylketone such as distearylketone. Among these waxes including a carbonyl group, polyesteralkanate is preferably used.

The wax for use in the present invention usually has a melting point of from 40 to 160° C., preferably of from 50 to 120° C., and more preferably of from 60 to 90° C. A wax having a melting point less than 40° C. has an adverse effect on its high temperature preservability, and a wax having a melting point greater than 160° C. tends to cause cold offset of the resultant toner when fixed at a low temperature. In addition, the wax preferably has a melting viscosity of from 5 to 1,000 cps, and more preferably of from 10 to 100 cps when measured at a temperature higher than the melting point by 20° C. A wax having a melting viscosity greater than 1,000 cps makes it difficult to improve hot offset resistance and low temperature fixability of the resultant toner. The toner preferably includes a wax in an amount of from 1 to 40% by weight, and more preferably from 3 to 30% by weight. When greater than 40% by weight, the resultant toner possibly deteriorates in fluidity.

Any known positive or negative charge controlling agents can be used according to the polarity of the photoreceptor. Specific examples of the negative charge controlling agents include resins and compounds having an electron-donating group, azo dyes, metal complexes of organic acids, etc. Specific examples of the marketed products of the negative charge controlling agents include BONTRON S-31, S-32, S-34, S-36, S-37, S-39, S-40, S-44, E-81, E-82, E-84, E-86, E-88, A, 1-A, 2-A and 3-A (from Orient Chemical Industries, Ltd.); KAYACHARGE N-1 and N-2, KAYASET BLACK T-2 and 004 (from Nippon Kayaku Co., Ltd.); AIZENSPIRON BLACK T-37, T-77, T-95, TRH and TNS-2 (from Hodogaya Chemical Co., Ltd.); FCA-1001-N, FCA-1001-NB and FCA-1001-NZ (from Fujikura Kasei Co., Ltd.); etc.

Specific examples of the positive charge controlling agents include basic compounds such as nigrosine dye, cationic compounds such as quaternary ammonium salts, metal salts of higher fatty acids, etc. Specific examples of the marketed products of the positive charge controlling agents include BONTRON N-01, N-02, N-03, N-04, N-05, N-07, N-09, N-10, N-11, N-13, P-51, P-52 and AFP-B (from Orient Chemical Industries, Ltd.); TP-302, TP-415 and TP-4040 (from Hodogaya Chemical Co., Ltd.); COPY BLUE PR, COPY CHARGE PX-VP-435 and NX-VP-434 (from Hoechst AG); FCA 201, 201-B-1, 201-B-2, 201-B-3, 201-PB, 201-PZ and 301 (from Fujikura Kasei Co., Ltd.); PLZ 1001, 2001, 6001 and 7001 (from Shikoku Corp.); etc.

These charge controlling agents can be used alone or in combination.

The content of the charge controlling agent is determined depending on the species of the binder resin used, and toner manufacturing method (such as dispersion method) used, and is not particularly limited. However, the content of the charge controlling agent is typically from 0.1 to 10 parts by weight, and preferably from 0.2 to 5 parts by weight, per 100 parts by weight of the binder resin included in the toner. When the content is too high, the toner has too large a charge quantity, and thereby the electrostatic force of a developing roller attracting the toner increases, resulting in deterioration of the fluidity of the toner and image density of the toner images.

The toner for use in the present invention optionally includes other materials such as inorganic particles, fluidity improving agents, cleanability improving agents, magnetic materials, metal soaps, etc.

Specific examples of the inorganic particles include silica, titania, alumina, cerium oxide, strontium titanate, calcium carbonate, magnesium carbonate, calcium phosphate, etc. Among these, hydrophobized silica particles treated by silicone oil or hexamethyldisilazane and surface-treated titanium oxide are more preferably used.

Specific examples of the marketed products of the inorganic particles include AEROSIL (130, 200V, 200CF, 300, 300CF, 380, OX50, TT600, MOX80, MOX170, COK84, RX200, RY200, R972, R974, R976, R805, R811, R812, T805, R202, VT222, RX170, RXC, RA200, RA200H, RA200HS, RM50, RY200 and REA200) from Nippon Aerosil Co., Ltd.; HDK (H20, H2000, H3004, H2000/4, H2050EP, H2015EP, H3050EP and KHD50, and HVK2150) from Wacker Chemie AG; CAB-O-SIL® (L-90, LM-130, LM-150, M-5, PTG, MS-55, H-5, HS-5, EH-5, LM-150D, M-7D, MS-75D, TS-720, TS-610 and TS-530) from Cabot Corporation; etc.

The content of the inorganic particles is typically from 0.1 to 5.0 parts by weight, and preferably from 0.5 to 3.2 parts by weight, per 100 parts by weight of the mother toner particles.

Methods of preparing the toner are not particularly limited as mentioned above, and a pulverization method is exemplified as follows.

A mixture of these toner constituent materials is melt-kneaded using kneaders. Specific examples of the kneaders include continuous kneaders such as single screw kneader and twin screw kneader, and batch kneaders such as roll mill. Specific examples of the marketed kneaders include TWIN SCREW EXTRUDER KTK (from Kobe Steel, Ltd.), TWIN SCREW COMPOUNDER TEM (from Toshiba Machine Co., Ltd.), MIRACLE K.C.K (from Asada Iron Works Co., Ltd.), TWIN SCREW EXTRUDER PCM (from Ikegai Co., Ltd), KOKNEADER (from Buss Corporation), etc. Melt-kneading preferably performed under the condition in which the molecular chain of the binder resin cannot be cut. In particular, a melt-kneading temperature is determined depending on the melting point of the binder resin. When the melt-kneading temperature is much higher than the melting point, the molecular chain is easily cut. When the melt-kneading temperature is much lower than the melting point, the materials cannot be well dispersed. The kneaded mixture is then subjected to pulverization. The kneaded mixture is preferably subjected to coarse pulverization at first, followed by fine pulverization. Suitable pulverization methods include: a method in which the particles collide with a collision board in a jet stream; a method in which the particles collide with each other in a jet mill; and the particles are pulverized in a narrow gap formed between a mechanically rotating rotor and a stator.

The pulverized particles are classified to prepare particles having a predetermined particle diameter. Suitable classification methods include cyclone separation, decantation, centrifugal separation, etc. Particles having a small particle diameter can be removed by these methods.

After subjecting to the classification mentioned above, the particles are further classified by a centrifugal force in airflow to prepare a toner having a predetermined particle diameter.

In order to improve fluidity, preservability, developability and transferability of the toner, the thus prepared mother toner particles can be mixed with an external additive (i.e., in organic particles such as hydrophobic silica). Suitable mixers for use in mixing the mother toner particles and an external additive include known mixers for mixing powders, which preferably have a jacket to control the inside temperature thereof. By changing the timing when the external additive is added or the addition speed of the external additive, the stress on the external additive (i.e., the adhesion state of the external additive with the mother toner particles) can be changed. Of course, by changing rotating number of the blade of the mixer used, mixing time, mixing temperature, etc., the stress can also be changed. In addition, a mixing method in which at first a relatively high stress is applied and then a relatively low stress is applied to the external additive, or vice versa, can also be used. Specific examples of the mixers include V-form mixers, locking mixers, Loedge Mixers, NAUTER MIXERS, HENSCHEL MIXERS and the like mixers. Then, coarse particles and aggregation particles are removed from a coarse toner through a sieve to prepare a toner.

The developer including the carrier and the toner used in the image forming apparatus 100 as the supplemental developer and the developer readily contained in the image developer has stable developability even after used for long periods, preventing the carrier from being abraded and the toner from adhering thereto, and preventing the developer in the developer container 14 from deteriorating its charge ability and the carrier from deteriorating its electrical resistivity.

In addition, the carrier adheres much less to a solid image because large deterioration of the resistivity and local deterioration thereof are prevented.

Deterioration of Image quality and durability because of the carrier adherence to images and reduction of the developer in the developer container 14 are effectively prevented. Therefore, quality images can be produced for long periods.

Not including carbon black and having an adjusted resistivity, the developer can produces high-quality color images having high color reproducibility and definition without color contamination while maintaining stable chargeability even when used in a color image forming apparatus.

Embodiments of the image forming apparatus for use in the present invention are not limited to the above-mentioned embodiment, and other image forming apparatus having functions similar thereto can also be used.

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Example 1

The following materials were dispersed by a homomixer for 15 min to prepare a liquid solution for forming a coated film.

| | |
|---|---|
| Silicone resin solution SR2410 from Dow Corning Toray Silicone Co., Ltd. | 425 |
| Amino silane SH6020 from Dow Corning Toray Silicone Co., Ltd. | 0.858 |
| Nonconductive alumina having an average particle diameter of 0.3 μm | 85.4 |
| Toluene | 300 |

The liquid solution for forming a coated film was coated and dried on a calcined ferrite powder having a weight-average particle diameter of 35 μm by SPIRA COTA, wherein the temperature was 40° C., from OKADA SEIKO CO., LTD. such that the coated film has a thickness of 0.5 μm to prepare a carrier 1. The resultant carrier was calcined in an electric oven at 300° C. for 1 hr. After cooled, the carrier was sieved through openings of 63 μm to have alumina of 50% by weight, a D/h of 0.6, an average difference of elevation of 0.08 μm, a volume resistivity of $10^{14.2}\Omega\cdot$cm and a magnetization of 68 A $m^2$/kg.

The volume-average particle diameter of the core material is determined using MICROTRAC® SRA (from Nikkiso Co., Ltd.) at a measurement range of from 0.7 to 125 μm.

The thickness (h) of the coated film is an average thickness of a resin covering the surface of the carrier, which is measured by observing the cross-section thereof with a transmission electron microscope (TEM). Specifically, 50 distances from the surface of the carrier to the surface of the coated layer are measured and an average thereof is determined to be the thickness (h) μm.

The average particle diameter (D) of the particulate material is measured as follows:

placing 30 ml of amino silane (SH6020 from Dow Corning Toray Silicone Co., Ltd.) and 300 ml of toluene in a juicer-mixer; placing 6.0 g of a sample therein;

dispersing the mixture in the juicer-mixer at a low speed to prepare a dispersion;

placing the dispersion in 500 ml of toluene in a beaker having a capacity of 1,000 ml to be diluted to prepare a dilution; and measuring the volume-average particle diameter of the sample by a centrifugal automatic particle diameter distribution measurer CAPA-700 from Horiba, Ltd. while stirring the dilution constantly by a homogenizer under the following conditions:

rotation speed: 2,000 rpm
maximum particle diameter: 2.0 μm
minimum particle diameter: 0.1 μm
particle diameter interval: 0.1 μm
dispersion medium viscosity: 0.59 mPa·s
dispersion medium density: 0.87 g/$CM^3$ particle density: the density of the inorganic particulate material is an absolute specific gravity measured by a dry automatic bulk density meter ACUPIC 1330 from Shimadzu Corporation.

The thickness (h) of the coated film is an average thickness of a resin covering the surface of the carrier, which is measured by observing the cross-section thereof with a transmission electron microscope (TEM). Specifically, 50 distances from the surface of the carrier to the surface of the coated layer are measured and a difference between an average of the major 5 values and an average of minor 5 values is determined to be the thickness (h) μm.

(Synthesis of Binder Resin)

724 parts of an adduct of bisphenol A with 2 moles of ethyleneoxide, 276 parts isophthalic acid and 2 parts of dibutyltinoxide were mixed and reacted in a reactor vessel including a cooling pipe, a stirrer and a nitrogen inlet pipe for 8 hrs at a normal pressure and 230° C. Further, after the mixture was depressurized by 10 to 15 mm Hg and reacted for 5 hrs, 32 parts of phthalic acid anhydride were added thereto and reacted for 2 hrs at 160° C. Next, the mixture was reacted with 188 parts of isophoronediisocyanate in ethyl acetate for 2 hrs at 80° C. to prepare a prepolymer including isocyanate (P1). Next, 267 parts of the prepolymer (P1) and 14 parts of isophoronediamine were mixed for 2 hrs at 50° C. to prepare a urea-modified polyester resin (U1) having a weigh-average molecular weight of 64,000. Similarly, 724 parts of an adduct of bisphenol A with 2 moles of ethyleneoxide and 276 parts of terephthalic acid were polycondensated for 8 hrs at a normal pressure and 230° C., and further, after the mixture was depressurized by 10 to 15 mm Hg and reacted for 5 hrs to prepare a unmodified polyester resin (E1) having a peak molecular weight of 5,000. 200 parts of the urea-modified polyester (U1) and 800 parts of the unmodified polyester resin (E1) were dissolved and mixed in 2,000 parts of a mixed solvent formed of ethylacetate and MEK (1/1) to prepare a binder resin (B1) ethyl acetate/MEK solution. The binder resin (B1) ethyl acetate/MEK solution was partially depressurized and dried to isolate the binder resin (B1). The toner binder resin (1) had a glass transition temperature (Tg) of 62° C.

(Synthesis of Polyester Resin A)

The following materials were placed in four-neck round bottomed flask having a thermometer, a stirrer, a condenser, a nitrogen inlet pipe and a capacity of 1 L.

| | |
|---|---|
| Terephthalic acid | 60 |
| Dodecenyl succinic anhydride | 25 |
| Trimellitic acid anhydride | 15 |
| Bisphenol A (2,2)propyleneoxide | 70 |
| Bisphenol A (2,2)ethyleneoxide | 50 |

The flask was set in a mantle heater and nitrogen gas introduced therein from the nitrogen inlet pipe, and the flask was heated while maintaining the inside thereof under an inactive atmosphere. Next, 0.05 g of dibutyltinoxide was added thereto and reacted therein while maintaining the temperature therein at 200° C. to prepare polyester A. The polyester A had a peak molecular weight of 4,200 and a glass transition temperature of 59.4° C.

(Preparation of Masterbatch 1)

The following materials were mixed with HENSCHEL MIXER To prepare a mixture wherein water penetrated a pigment aggregate.

| | |
|---|---|
| C.I. Pigment Yellow 155 | 40 |
| Polyester resin A | 60 |
| Water | 30 |

The mixture was kneaded with two-roll mill at 130° C. for 45 min and pulverized to have a diameter of 1 mm. Thus, a masterbacth (M1) was prepared.

(Preparation of Toner 1)

240 parts of the binder resin (B1) ethyl acetate/MEK solution, 20 parts of pentaerythritoltetrabehenate having a melting point of 81° C. and a melting viscosity of 25 cps and 8 parts of the masterbatch (M1) were uniformly be dissolved and dispersed with TK-HOMOMIXER at 12,000 rpm and 60° C. in a beaker to prepare a toner constituents liquid.

706 parts of ion-exchanged water, 294 parts of hydroxyapatite suspension liquid having a concentration of 10% (Supertite 10 from Nippon Chemical Industrial Co., Ltd.) and 0.2 parts of sodium dodecylbenzenesulfonate were uniformly dissolved in a beaker to prepare a solution. The solution was heated to have a temperature of 60° C. and the toner constituents liquid was put therein while stirred with TK-HOMOMIXER at 12,000 rpm for 10 min to prepare a liquid mixture.

The liquid mixture was placed in a flask having a stirrer and a thermometer and heated to have a temperature of 98° C., and a solvent was removed therefrom, filtered, washed, dried and wind-classified to prepare a parent toner.

100 parts of the parent toner and each 1.0 part of hydrophobic silica and hydrophobized titanium oxide were mixed with HENSCHEL MIXER to prepare a toner 1.

An ultra-thin slice of the toner 1 was photographed using a TEM (H-9000H from Hitachi, Ltd., ×100,000), and an average of dispersion diameters of randomly selected 100 colorants was determined. The dispersion diameter was an average of the maximum and minimum diameters of a colorant, and an aggregated colorants was counted as a colorant.

The colorant had an average dispersion diameter of 0.40 μm. A ratio of the colorants having a dispersion diameter not less than 0.7 μm was 4.5%.

The toner 1 had a volume-average particle diameter of 6.2 μm and a number-average particle diameter of 5.1 μm when measured with Coulter Counter TA2 from Coulter Electronics Corp. at an aperture diameter of 100 μm.

The average circularity of the toner 1 was measured with flow-type particle image analyzer FPIA-1000 from SYSMEX CORP. A measurement liquid was prepared by the following method and set therein:

0.1 to 0.5 ml of a surfactant (alkylbenzenesulfonate salt) was added to 100 to 150 ml of water impurities were ready removed from as a dispersant to prepare an aqueous solution;

adding 0.1 to 0.5 g of a measurement sample thereto; and dispersing the aqueous solution with an ultrasonic disperser for 1 to 3 min to prepare a measurement liquid including 3,000 to 10,000 pieces/μl.

The average circularity of the toner 1 was 0.96.

Next, 7 parts of the toner 1 and 93 parts of the carrier 1 were mixed and stirred to prepare a developer having a toner concentration of 7%.

The image definition, durability (charge deterioration and resistivity variation) and carrier adherence (to background (edge effect) and to solid image) of the developer were evaluated. The results are shown in Table 1.

(Charge Quantity)

The charge quantity was measured with a blow-off apparatus TB-200 from Toshiba Chemical Co., Ltd.

(Volume Resistivity)

The carrier was placed in a gap of 2 mm between parallel electrodes of a high resist meter and a DC voltage of 250 V was applied thereto for 30 sec to measure the volume resistivity.

(Image Definition)

The developer was set in a modified digital color printer Imagio Neo C600 from Ricoh Company, Ltd. having the image developer in FIG. 2 such that the carrier in the supplemental developer had a ratio of 20% by weight. A letter chart having an image area of 5% and a letter of 2 mm×2 mm was produced thereby, and the image definition thereof was evaluated.

◎: very good

○: good

Δ: practically usable x: practically unusable

◎, ○ and Δ were acceptable and x was unacceptable.

(Edge Effect)

The developer was set in a modified digital color printer Imagio Neo C600 from Ricoh Company, Ltd. having the image developer in FIG. 2 such that the carrier in the supplemental developer had a ratio of 20% by weight. A A3 letter chart having an image area of 1% and a letter of 2 mm×2 mm was produced thereby fixing the background potential at 150 V, the number of the carriers adhering to the background was counted.

◎: 0

○: 2 to 5

Δ: 6 to 10 x: 11 or more

◎, ○ and Δ were acceptable and x was unacceptable.

(Durability)

The developer was set in a modified digital color printer Imagio Neo C600 from Ricoh Company, Ltd. having the image developer in FIG. 2 such that the carrier in the supplemental developer had a ratio of 20% by weight. After 100,000 monochrome images were continuously produced thereby, a charge loss and a resistivity loss of the carrier were evaluated.

The charge loss is a difference (Q1−Q2) between a charge quantity Q1 of the initial carrier and a charge quantity Q2 of the carrier after 100,000 monochrome images were continuously produced, wherein the charge quantity Q2 was measured by separating 95 parts of the carrier from 5 parts of the toner with a blow-off apparatus TB-200 from Toshiba Chemical Co., Ltd. after 100,000 images were produced. The difference is preferably 10.0 μC/g or less. The change loss is caused by a toner spent on the carrier, and therefore the charge loss can be prevented when the toner spent thereon is reduced.

The resistivity loss is an absolute value of a difference (|R1−R2|) between a resistivity loss R1 of the initial carrier and a resistivity loss R2 after 100,000 images were produced, wherein the resistivity loss R2 was measured by separating the carrier from the toner with a blow-off apparatus TB-200 from Toshiba Chemical Co., Ltd. after 100,000 images were produced. The respective resistivities were measured by placing the respective carriers in a gap of 2 mm between parallel electrodes of a high resist meter, applying a DC voltage of 250 V thereto for 30 sec to measure the resistivities, and converting the resultant resistivities to a volume resistivities R1 and R2. The difference is preferably 3.0Ω·cm or less. The resistivity loss is caused by abrasion of the coated film of the carrier, a toner spent thereon and a separation of a particulate material from the coated film thereof. Therefore, the resistivity loss can be prevented when these are reduced.

(Carrier Adherence)

After the durability test, a A3-size solid image was produced by the same modified digital color printer Imagio Neo C600 from Ricoh Company, Ltd., and the number of white spots and the carrier adhering to the image were counted. The carrier in the supplemental developer had a ratio of 10% by weight.

◎: 0

○: 2 to 5

Δ: 6 to 10 x: 11 or more

◎, ○ and Δ were acceptable and x was unacceptable.

Example 2

The following materials were dispersed by a homomixer for 15 min to prepare a liquid solution for forming a coated film.

| | |
|---|---|
| Acrylic resin solution HITALOID 3001 from Hitachi Chemical Co., Ltd., | 118.69 |
| Guanamine solution MYCOAT 106 from Cytec Industries, Inc. | 18 |
| Acidic catalyst 4040 from Cytec Industries, Inc. | 0.68 |
| Nonconductive alumina having an average particle diameter of 0.3 μm | 85.4 |
| Toluene | 800 |

The liquid solution for forming a coated film was coated and dried on a calcined ferrite powder having a weight-average particle diameter of 35 μm by SPIRA COTA, wherein the temperature was 40° C., from OKADA SEIKO CO., LTD. such that the coated film has a thickness of 0.5 μm. The resultant carrier was calcined in an electric oven at 150° C. for 1 hr. After cooled, the carrier was sieved through openings of 63 μm to have alumina of 50% by weight, a D/h of 0.6, an average difference of elevation of 0.08 μm, a volume resistivity of $10^{14.4}$Ω·cm and a magnetization of 68 A $m^2$/kg.

The procedures for evaluation of the developer in Example 1 were repeated to evaluate the developer except for using this carrier.

Example 3

The following materials were dispersed by a homomixer for 15 min to prepare a liquid solution for forming a coated film.

| | |
|---|---|
| Acrylic resin solution HITALOID 3001 from Hitachi Chemical Co., Ltd., | 51.61 |
| Guanamine solution MYCOAT 106 from Cytec Industries, Inc. | 16.12 |
| Acidic catalyst 4040 from Cytec Industries, Inc. | 0.28 |
| Silicone resin solution SR2410 from Dow Corning Toray Silicone Co., Ltd. | 241.5 |
| Amino silane SH6020 from Dow Corning Toray Silicone Co., Ltd. | 0.55 |
| Nonconductive alumina having an average particle diameter of 0.3 μm | 86.1 |
| Toluene | 800 |

The procedure for preparation of the developer in Example 2 was repeated to prepare a developer except for using the above-mentioned liquid solution for forming a coated film. The carrier had the alumina of 50% by weight, a D/h of 0.55, an average difference of elevation of 0.08 μm, a volume resistivity of $10^{15.2}$Ω·cm and a magnetization of 68 A $m^2$/kg.

The procedures for evaluation of the developer in Example 1 were repeated to evaluate the developer except for using this carrier.

Example 4

The procedure for preparation of the developer in Example 3 was repeated to prepare a developer except for changing the quantity of the alumina from 86.1 to 8.6. The carrier had the alumina of 9% by weight, a D/h of 0.7, an average difference of elevation of 1.5 μm, a volume resistivity of $10^{12.2}$Ω·cm and a magnetization of 68 A $m^2$/kg.

The procedures for evaluation of the developer in Example 1 were repeated to evaluate the developer except for using this carrier.

Example 5

The procedure for preparation of the developer in Example 3 was repeated to prepare a developer except for changing the quantity of the alumina from 86.1 to 344.4. The carrier had the alumina of 80.1% by weight, a D/h of 0.3, an average difference of elevation of 1.8 μm, a volume resistivity of $10^{16.6}$Ω·cm and a magnetization of 68 A $m^2$/kg.

The procedures for evaluation of the developer in Example 1 were repeated to evaluate the developer except for using this carrier.

Example 6

The procedure for preparation of the developer in Example 3 was repeated to prepare a developer except for changing the quantity of the alumina from 86.1 to 50. The carrier had the alumina of 37% by weight, a D/h of 0.66, an average difference of elevation of 1.3 μm, a volume resistivity of $10^{12.3}$Ω·cm and a magnetization of 68 A $m^2$/kg.

The procedures for evaluation of the developer in Example 1 were repeated to evaluate the developer except for using this carrier.

Example 7

The procedure for preparation of the developer in Example 3 was repeated to prepare a developer except for changing the quantity of the alumina from 86.1 to 250. The carrier had the alumina of 74.5% by weight, a D/h of 0.33, an average difference of elevation of 1.5 μm, a volume resistivity of $10^{16.6}\Omega\cdot$cm and a magnetization of 68 A $m^2$/kg.

The procedures for evaluation of the developer in Example 1 were repeated to evaluate the developer except for using this carrier.

Example 8

The procedure for preparation of the developer in Example 3 was repeated to prepare a developer except for changing the quantity of the alumina from 86.1 to 29. The carrier had the alumina of 25.2% by weight, a coverage thereof of 19.9, a D/h of 0.65, an average difference of elevation of 1.1 μm, a volume resistivity of $10^{13.0}\Omega\cdot$cm and a magnetization of 68 A $m^2$/kg.

The procedures for evaluation of the developer in Example 1 were repeated to evaluate the developer except for using this carrier.

Example 9

The procedure for preparation of the developer in Example 3 was repeated to prepare a developer except for replacing 86.1 parts of the nonconductive alumina with 15 parts of titanium oxide having an average particle diameter of 0.02 μm. The carrier had the titanium oxide of 14.9% by weight, a coverage thereof of 32.8, a D/h of 0.05, an average difference of elevation of 0.08 μm, a volume resistivity of $10^{14.4}\Omega\cdot$cm and a magnetization of 66 A $m^2$/kg.

The procedures for evaluation of the developer in Example 1 were repeated to evaluate the developer except for using this carrier.

Example 10

The procedure for preparation of the developer in Example 3 was repeated to prepare a developer except for replacing 86.1 parts of the nonconductive alumina with 86.1 parts of a surface-treated conductive alumina having an average particle diameter of 0.35 μm and a volume resistivity of 3.5Ω·cm. The surface-treated layer includes two layers of an underlayer formed of tin dioxide and an upper layer formed of indium oxide including tin dioxide. The carrier had the surface-treated alumina of 50% by weight, a D/h of 0.63, an average difference of elevation of 0.08 μm and a volume resistivity of $10^{9.8}\Omega\cdot$cm.

The procedures for evaluation of the developer in Example 1 were repeated to evaluate the developer except for using this carrier.

Example 11

The procedure for preparation of the developer in Example 3 was repeated to prepare a developer except for replacing 241.5 of the silicone resin solution SR2410 with 350.5 thereof and 86.1 parts of the nonconductive alumina with 36.4 parts thereof. The carrier had the alumina of 77% by weight, a D/h of 0.38, an average difference of elevation of 1.8 μm, a volume resistivity of $10^{17.2}\Omega\cdot$cm and a magnetization of 68 A $m^2$/kg.

The procedures for evaluation of the developer in Example 1 were repeated to evaluate the developer except for using this carrier.

Example 12

The procedure for preparation of the developer in Example 3 was repeated to prepare a developer except for replacing 51.61 parts of the acrylic resin solution HITALOID 3001 with 5.2 parts thereof, 16.12 parts of the guanamine solution MYCOAT 106 with 1.6 parts thereof, 0.28 parts of the catalyst 4040 with 0.14 parts thereof, 241.5 parts of the silicone resin solution SR2410 with 24.15 parts thereof and 86.1 parts of the nonconductive alumina with 8.5 parts of titanium oxide having an average particle diameter of 0.02 μm. The carrier had the titanium oxide of 50% by weight, a coated film having an average thickness of 0.04 μm, a D/h of 0.5, an average difference of elevation of 0.05 μm and a volume resistivity of $10^{13.0}\Omega\cdot$cm.

The procedures for evaluation of the developer in Example 1 were repeated to evaluate the developer except for using this carrier.

Example 13

The procedure for preparation of the developer in Example 3 was repeated to prepare a developer except for replacing 51.61 parts of the acrylic resin solution HITALOID 3001 with 206.4 parts thereof, 16.12 parts of the guanamine solution MYCOAT 106 with 64.4 parts thereof and 241.5 parts of the silicone resin solution SR2410 with 966 parts thereof. The carrier had the alumina of 50% by weight, a coated film having an average thickness of 4.3 μm, a D/h of 0.07, an average difference of elevation of 0.09 μm, a volume resistivity of $10^{16.9}\Omega\cdot$cm and a magnetization of 68 A $m^2$/kg.

The procedures for evaluation of the developer in Example 1 were repeated to evaluate the developer except for using this carrier.

Example 14

The procedure for preparation of the developer in Example 3 was repeated to prepare a developer except for replacing 51.61 parts of the acrylic resin solution HITALOID 3001 with 103.2 parts thereof, 16.12 parts of the guanamine solution MYCOAT 106 with 32.2 parts thereof and 241.5 parts of the silicone resin solution SR2410 with 483 parts thereof. The carrier had the alumina of 33.5% by weight, a coated film having an average thickness of 2.1 μm, a D/h of 0.07, an average difference of elevation of 0.06 μm, a volume resistivity of $10^{16.8}\Omega\cdot$cm and a magnetization of 68 A $m^2$/kg.

The procedures for evaluation of the developer in Example 1 were repeated to evaluate the developer except for using this carrier.

Example 15

The procedure for preparation of the developer in Example 3 was repeated to prepare a developer except for coating the liquid solution for forming a coated film on a calcined ferrite powder having a weight-average particle diameter of 35 μm and a low magnetization. The carrier had the alumina of 50% by weight, a D/h of 0.55, a volume resistivity of $10^{15.2}\Omega\cdot$cm and a magnetization of 36 A $m^2$/kg.

The procedures for evaluation of the developer in Example 1 were repeated to evaluate the developer except for using this carrier.

Example 16

The procedure for preparation of the developer in Example 3 was repeated to prepare a developer except for coating the liquid solution for forming a coated film on a calcined ferrite powder having a weight-average particle diameter of 35 μm and a high magnetization. The carrier had the alumina of 50% by weight, a D/h of 0.55, a volume resistivity of $10^{15.3}\Omega\cdot$cm and a magnetization of 94 A $m^2$/kg.

The procedures for evaluation of the developer in Example 1 were repeated to evaluate the developer except for using this carrier.

Example 17

The procedure for preparation of the developer in Example 3 was repeated to prepare a developer except for replacing 51.61 parts of the acrylic resin solution HITALOID 3001 with 206.4 parts thereof, 16.12 parts of the guanamine solution MYCOAT 106 with 64.4 parts thereof, 241.5 parts of the silicone resin solution SR2410 with 966 parts thereof and 86.1 parts of the nonconductive alumina with 172.2 parts thereof, and changing the weight-average particle diameter of the resultant carrier to 19 μm. The carrier had the alumina of 53% by weight, a D/h of 0.52, an average difference of elevation of 1.1 μm, a volume resistivity of $10^{15.0}\Omega\cdot$cm and a magnetization of 94 A $m^2$/kg.

The procedures for evaluation of the developer in Example 1 were repeated to evaluate the developer except for using this carrier.

Example 18

The procedure for preparation of the developer in Example 3 was repeated to prepare a developer except for changing the weight-average particle diameter of the resultant carrier to 67 μm. The carrier had the alumina of 49% by weight, a D/h of 0.27, an average difference of elevation of 0.055 μm, a volume resistivity of $10^{12.5}\Omega\cdot$cm and a magnetization of 69 A $m^2$/kg.

The procedures for evaluation of the developer in Example 1 were repeated to evaluate the developer except for using this carrier.

Example 19

The procedures for preparation and evaluation of the developer in Example 3 were repeated to prepare and evaluate a developer except for changing the weight ratio of the carrier in the supplemental developer to 5% by weight.

Example 20

The procedures for preparation and evaluation of the developer in Example 3 were repeated to prepare and evaluate a developer except for changing the weight ratio of the carrier in the supplemental developer to 2% by weight.

Comparative Example 1

The procedure for preparation of the developer in Example 3 was repeated to prepare a developer except for replacing 51.61 parts of the acrylic resin solution HITALOID 3001 with 25 parts thereof, 16.12 parts of the guanamine solution MYCOAT 106 with 8 parts thereof, 0.28 parts of the catalyst 4040 with 0.14 parts thereof, 241.5 parts of the silicone resin solution SR2410 with 120.5 parts thereof and 86.1 parts of the nonconductive alumina with 28.7 parts thereof. The carrier had the alumina of 40.5% by weight, a D/h of 1.13, an average difference of elevation of 1.95 μm, a volume resistivity of $10^{13.2}\Omega\cdot$cm and a magnetization of 68 A $m^2$/kg.

The procedures for evaluation of the developer in Example 1 were repeated to evaluate the developer except for using this carrier.

Comparative Example 2

The procedure for preparation of the developer in Example 3 was repeated to prepare a developer except for replacing 51.61 parts of the acrylic resin solution HITALOID 3001 with 206.4 parts thereof, 16.12 parts of the guanamine solution MYCOAT 106 with 64.4 parts thereof, 241.5 parts of the silicone resin solution SR2410 with 966 parts thereof and 86.1 parts of the nonconductive alumina with 430 parts of titanium oxide having an average particle diameter of 0.02 μm, and changing the weight-average particle diameter of the resultant carrier to 19 μm. The carrier had the titanium oxide of 71.6% by weight, a D/h of 0.009, an average difference of elevation of 0.055 μm, a volume resistivity of $10^{16.5}\Omega\cdot$cm and a magnetization of 68 A $m^2$/kg.

The procedures for evaluation of the developer in Example 1 were repeated to evaluate the developer except for using this carrier.

Comparative Example 3

The following materials were dispersed by a homomixer for 10 min to prepare a liquid solution for forming a coated film.

| | |
|---|---|
| Acrylic resin solution HITALOID 3001 from Hitachi Chemical Co., Ltd., | 56.0 |
| Guanamine solution MYCOAT 106 from Cytec Industries, Inc. | 15.6 |
| Alumina having an average particle diameter of 0.3 μm and a resistivity of $10^{14}\ \Omega\cdot$cm | 160.0 |
| Toluene | 900 |
| Butyl cellosolve | 900 |

The procedure for preparation of the developer in Example 3 was repeated to prepare a developer except for coating and drying the liquid solution for forming a coated film on a calcined ferrite powder having a weight-average particle diameter of 35 μm by SPIRA COTA, wherein the temperature was 40° C., from OKADA SEIKO CO., LTD. such that the coated film has a thickness of 0.15 μm. The carrier had the alumina of 80% by weight, a D/h of 2.0, an average difference of elevation of 0.01 μm, a volume resistivity of $10^{15.1}\Omega\cdot$cm and a magnetization of 68 A $m^2$/kg.

The procedures for evaluation of the developer in Example 1 were repeated to evaluate the developer except for using this carrier.

Comparative Example 4

The following materials were dispersed by a homomixer for 10 min to prepare a liquid solution for forming a coated film.

| | |
|---|---|
| Acrylic resin solution HITALOID 3001 from Hitachi Chemical Co., Ltd., | 56.0 |
| Guanamine solution MYCOAT 106 from Cytec Industries, Inc. | 15.6 |
| Silicone resin solution SR2410 from Dow Corning Toray Silicone Co., Ltd. | 241.5 |
| Alumina having an average particle diameter of 0.3 μm and a resistivity of $10^{14}\ \Omega\cdot$cm | 88.3 |
| Toluene | 900 |

The procedure for preparation of the developer in Example 3 was repeated to prepare a developer except for coating and drying the liquid solution for forming a coated film on a calcined ferrite powder having a weight-average particle diameter of 35 μm by SPIRA COTA, wherein the temperature was 40° C., from OKADA SEIKO CO., LTD. such that the coated film has a thickness of 0.55 μm. The carrier had the alumina of 50% by weight, a D/h of 0.55, an average difference of elevation of 0.008 μm, a volume resistivity of $10^{15.1}$Ω·cm and a magnetization of 68 A $m^2$/kg.

The procedures for evaluation of the developer in Example 1 were repeated to evaluate the developer except for using this carrier.

Comparative Example 5

The procedure for preparation of the developer in Example 3 was repeated to prepare a developer except for replacing 86.1 parts of the nonconductive alumina with 258.1 parts thereof, and dispersing the liquid solution for forming a coated film by a homomixer for 10 min. The carrier had the alumina of 68% by weight, a D/h of 0.41, an average difference of elevation of 2.2 μm, a volume resistivity of $10^{15.2}$Ω·cm and a magnetization of 68 A $m^2$/kg.

The procedures for evaluation of the developer in Example 1 were repeated to evaluate the developer except for using this carrier.

Comparative Example 6

The procedures for preparation and evaluation of the developer in Example 3 were repeated to prepare and evaluate a developer except for replacing the image developer with an image developer without a developer discharger 300 as shown in FIG. 2 and the supplemental developer with a developer without a carrier, i.e., a toner.

The procedures for evaluation of the developer in Example 1 were repeated to evaluate the developer except for using this carrier.

TABLE 1

| | Carrier adherence | Edge effect | Image definition | Durability: Charge loss (μC/g) | Durability: Resistivity loss [Log (Ω · cm)] |
|---|---|---|---|---|---|
| Example 1 | ◎ | ◎ | ◎ | 2.1 | 1.4 |
| Example 2 | ◎ | ◎ | ◎ | 1.4 | 0.5 |
| 0.1Example 3 | ◎ | ◎ | ◎ | 0.2 | 0.1 |
| Example 4 | ○ | ◎ | ○ | 6.5 | 0.9 |
| Example 5 | ◎ | ○ | ◎ | 1.5 | 2.8 |
| Example 6 | ◎ | ◎ | ◎ | 3.0 | 0.6 |
| Example 7 | ◎ | ○ | ◎ | 1.5 | 1.1 |
| Example 8 | ◎ | ◎ | ◎ | 4.0 | 1.9 |
| Example 9 | ◎ | ◎ | Δ | 4.0 | 2.8 |
| Example 10 | Δ | ◎ | ◎ | 1.7 | 1.1 |
| Example 11 | ◎ | Δ | ◎ | 1.3 | 1.0 |
| Example 12 | ◎ | ◎ | ○ | 3.5 | 2.5 |
| Example 13 | ◎ | ○ | Δ | 2.8 | 0.7 |
| Example 14 | ◎ | ○ | ○ | 5.1 | 0.5 |
| Example 15 | Δ | Δ | Δ | 4.0 | 1.5 |
| Example 16 | ◎ | ○ | Δ | 4.9 | 2.0 |
| Example 17 | Δ | ◎ | ◎ | 4.5 | 1.1 |
| Example 18 | ◎ | ◎ | Δ | 3.2 | 1.4 |
| Example 19 | ◎ | ◎ | ◎ | 1.0 | 0.5 |
| Example 20 | ◎ | ◎ | ◎ | 1.0 | 0.6 |
| Comparative Example 1 | X | ◎ | ○ | 2.1 | 4.5 |
| Comparative Example 2 | ○ | ○ | Δ | 10.1 | 2.5 |
| Comparative Example 3 | X | Δ | Δ | 11.8 | 4.9 |
| Comparative Example 4 | Δ | ○ | Δ | 12.5 | 3.8 |
| Comparative Example 5 | Δ | ○ | Δ | 5.4 | 5.4 |
| Comparative Example 6 | ○ | ◎ | ◎ | 11.0 | 2.5 |

Table 1 shows that the developers prepared in Examples 1 to 20 had good carrier adherence resistance, edge effect and image reproducibility, and well prevented charge and resistivity loss.

The carrier prepared in Comparative Example 1 did not have a coated layer having a sufficient thickness, and had a problem of abrasion resistance.

The carrier prepared in Comparative Example 2 did not have a coated layer having sufficient concavities and convexities, and a toner spent thereon was not sufficiently scraped off, resulting in a large charge loss.

The liquid solution for forming a coated film prepared Comparative Example 3 was not sufficiently stirred and the alumina was not sufficiently dispersed. Therefore, the resultant coated layer having sufficient concavities and convexities, and a toner spent thereon was not sufficiently scraped off, resulting in a large charge loss. In addition, the coated layer tended to locally peel off because the alumina was not sufficiently dispersed, resulting in a large resistivity loss.

The liquid solution for forming a coated film prepared Comparative Example 4 was not sufficiently stirred and the alumina was not sufficiently dispersed. Therefore, the resultant coated layer having sufficient concavities and convexities, and a toner spent thereon was not sufficiently scraped off, resulting in a large charge loss.

The liquid solution for forming a coated film prepared Comparative Example 5 was not sufficiently stirred, and the alumina was not sufficiently dispersed and agglutinated in the resultant coated layer. A toner spent thereon could be scraped off because the coated layer had large concavities and convexities, but they are so large that the toner tended to stay in the concavities. Further, a large block of the coated layer peeled off when stressed.

In Comparative Example 6, the image forming apparatus did not use the supplemental developer and the charge quantity of the developer and the resistivity of the carrier largely deteriorated after used for long periods.

This application claims priority and contains subject matter related to Japanese Patent Application No. 2006-285957 filed on Oct. 20, 2006, the entire contents of which are hereby incorporated by reference.

Having now fully described the invention, it will be apparent to one of ordinary skill in the art that many changes and modifications can be made thereto without departing from the spirit and scope of the invention as set forth therein.

What is claimed as new and desired to be secured by Letters Patent of the United States is:

1. A carrier for an image forming apparatus in which a toner and the carrier are fed to an image developer of the image forming apparatus and an extra developer comprising the toner and the carrier in the image developer is discharged therefrom, at least one of the carrier fed to the image developer and the carrier readily contained in the image developer comprising:

a core material; and a coated film coating the core material, wherein the coated film comprises a binder resin and a particulate material having a ratio of an average particle diameter of the carrier to an average thickness of the coated film of from 0.01 to 1, and comprises concavities and convexities having an average difference of elevation of from 0.02 to 3.0 μm.

2. The carrier of claim 1, wherein the particulate material has a ratio of from 10% to 80% by weight based on a total weight of the binder resin and the particulate material.

3. The carrier of claim 2, wherein the particulate material has a ratio of from 40% to 70% by weight based on total weight of the binder resin and the particulate material.

4. The carrier of claim 1, wherein a ratio of a product of a cross-sectional area of the particulate material and a number thereof to a product of a surface area of the core material and a number thereof is from 0.3 to 30.

5. The carrier of claim 1, wherein the carrier has a volume resistivity of from $1\times10^{10}\Omega\cdot$cm to $1\times10^{17}\Omega\cdot$cm.

6. The carrier of claim 1, wherein the particulate material is selected from the group consisting of alumina, silica and titanium.

7. The carrier of claim 1, wherein the coated film has an average thickness of from 0.05 to 4.00 μm.

8. The carrier of claim 7, wherein the coated film has an average thickness of from 0.05 to 2.00 μm.

9. The carrier of claim 1, wherein the binder resin has a glass transition temperature of from 20 to 100° C.

10. The carrier of claim 1, wherein the binder resin comprises at least one of a silicone resin and an acrylic resin.

11. The carrier of claim 1, wherein the carrier has a magnetization of from 40 to 90 A $m^2$/kg.

12. A supplemental developer in an image forming apparatus, the supplemental developer comprising:

a toner; and a carrier, wherein the supplemental developer is fed to an image developer of the image forming apparatus and an extra developer in the image developer is discharged therefrom, and wherein at least one of the carrier fed to the image developer and a carrier included in a developer readily contained in the image developer comprises:

a core material; and a coated film coating the core material, wherein the coated film comprises a binder resin and a particulate material having a ratio of an average particle diameter of the carrier to an average thickness of the coated film of from 0.01 to 1, and comprises concavities and convexities having an average difference of elevation of from 0.05 to 2.0 μm.

13. A supplemental developer comprising:

a toner; and the carrier according to claim 1.

14. The supplemental developer of claim 12, wherein the supplemental developer comprises the carrier in an amount not less than 3% and less than 30% by weight.

15. A supplemental developer comprising:

the carrier included in the developer readily contained in the image developer according to claim 1.

16. The supplemental developer of claim 12, wherein the developer readily contained in the image developer comprises the carrier in an amount of from 85% to 98% by weight.

17. A developer feeder, comprising:

a container configured to contain the supplemental developer according to claim 12; and a vacuum pump configured to vacuum up the supplemental developer to feed the supplemental developer to an image developer.

18. An image forming apparatus, comprising:

an image bearer configured to bear an image, a charge configured to charge the image bearer;

an irradiator configured to irradiate the image bearer to from an electrostatic latent image thereon;

an image developer configured to contain a developer comprising a toner and a carrier and develop the electrostatic latent image with therewith to form a toner image on the image bearer;

a developer feeder configured to feed a supplemental developer to the image developer; and a discharger configured to discharge an extra developer in the image developer, wherein the supplemental developer is the supplemental developer according to claim 12.

19. An image forming apparatus, comprising:

an image bearer configured to bear an image, a charge configured to charge the image bearer;

an irradiator configured to irradiate the image bearer to from an electrostatic latent image thereon;

an image developer configured to contain a developer comprising a toner and a carrier and develop the electrostatic latent image with therewith to form a toner image on the image bearer;

a developer feeder configured to feed a supplemental developer to the image developer; and a discharger configured to discharge an extra developer in the image developer, wherein the developer contained in the image developer is the supplemental developer according to claim 12.

20. The image forming apparatus of claim 19, wherein the supplemental developer comprises:

a toner; and a carrier;

wherein the supplemental developer is fed to an image developer of the image forming apparatus and an extra developer in the image developer is discharged therefrom, and wherein at least one of the carrier fed to the image developer and a carrier included in a developer readily contained in the image developer comprises:

a core material; and a coated film coating the core material, wherein the coated film comprises a binder resin and a particulate material having a ratio of an average particle diameter of the carrier to an average thickness of the coated film of from 0.01 to 1, and comprises concavities and convexities having an average difference of elevation of from 0.05 to 2.0 μm.

21. The image forming apparatus of claim 18, further comprising a developer feeder comprising:

a container configured to contain the supplemental developer; and a vacuum pump configured to vacuum up the supplemental developer to feed the supplemental developer to the image developer.

22. The image forming apparatus of claim 20, further comprising a developer feeder comprising:

a container configured to contain the supplemental developer; and a vacuum pump configured to vacuum up the supplemental developer to feed the supplemental developer to the image developer.

23. A process cartridge, comprising:

an image bearer configured to bear an image; and an image developer configured to contain a developer comprising a toner and develop an electrostatic latent image on the image bearer to form a toner image thereon, wherein the process cartridge is detachable from an image forming apparatus in which a supplemental developer is fed to the image developer and an extra developer in the image developer is discharged therefrom, and wherein the supplemental developer is the supplemental developer according to claim 12.

24. A process cartridge, comprising:

an image bearer configured to bear an image; and an image developer configured to contain a developer comprising a toner and develop an electrostatic latent image on the image bearer to form a toner image thereon, wherein the process cartridge is detachable from an image forming apparatus in which a supplemental developer is fed to the image developer and an extra developer in the image developer is discharged therefrom, and wherein the developer contained in the image developer is the supplemental developer according to claim 12.

* * * * *